US011242748B2

(12) United States Patent
Wang

(10) Patent No.: US 11,242,748 B2
(45) Date of Patent: Feb. 8, 2022

(54) TUNNELING DEVICE FOR PIPE JACKING AND ITS CONSTRUCTION METHOD

(71) Applicant: Yubin Wang, Jiangsu (CN)

(72) Inventor: Yubin Wang, Jiangsu (CN)

(73) Assignee: Yubin Wang, Wuxi (CN)

( * ) Notice: Subject to any disclaimer, the term of this patent is extended or adjusted under 35 U.S.C. 154(b) by 0 days.

(21) Appl. No.: 16/479,215

(22) PCT Filed: Jan. 13, 2018

(86) PCT No.: PCT/CN2018/072523
§ 371 (c)(1),
(2) Date: Jul. 18, 2019

(87) PCT Pub. No.: WO2018/133743
PCT Pub. Date: Jul. 26, 2018

(65) Prior Publication Data

US 2019/0383142 A1 Dec. 19, 2019

(30) Foreign Application Priority Data

Jan. 18, 2017 (CN) ..... 201710039173.8

(51) Int. Cl.
*E21D 9/00* (2006.01)
*E02F 5/06* (2006.01)
*E21D 9/12* (2006.01)

(52) U.S. Cl.
CPC ..... *E21D 9/005* (2013.01); *E02F 5/06* (2013.01); *E21D 9/122* (2013.01)

(58) Field of Classification Search
CPC . E21D 9/005; E21D 9/08; E21D 9/087; E02F 5/06
See application file for complete search history.

(56) References Cited

U.S. PATENT DOCUMENTS 3,711,159 A * 1/1973 Mazzotti ..... E21D 9/08 299/33
3,742,718 A * 7/1973 Weiss ..... E21D 9/005 405/184

(Continued)

FOREIGN PATENT DOCUMENTS

CN 201448113 U 5/2010
CN 102704944 A 10/2012

(Continued)

OTHER PUBLICATIONS

International Search Report and Written Opinion of the International Searching Authority. dated Apr. 13, 2018. International Application No. PCT/CN2018/072523.

*Primary Examiner* — Benjamin F Fiorello
(74) *Attorney, Agent, or Firm* — Nienstadt PLLC

(57) ABSTRACT

A tunneling apparatus for use in a pipe jacking method including an excavating apparatus, a head front-end track, a middle-section track, and a rear device. The excavating apparatus includes a transmission device and a chain blade. The transmission device includes a driving device and a sprocket. During construction, the chain blade for excavating rock and earth runs on the head front-end track and the middle-section track. The shape of a head excavation face is the same as that of the cross-section of a pipe section. The rear apparatus includes a jacking device mounted in a construction well. The front end of the middle-section track is connected to the head front-end track, and the tail end of the middle-section track is connected to the rear device. During construction, the driving device drives the chain blade, so that the chain blade runs along the tracks. Blades on the head front-end track excavate the ring-shaped rock and earth in a projection part of the cross-section of the pipe section.

11 Claims, 26 Drawing Sheets

(56) References Cited

U.S. PATENT DOCUMENTS 4,095,435 A * 6/1978 Uemura ..... E21D 9/005 405/135
4,116,011 A * 9/1978 Girault ..... E21D 9/005 405/134
4,166,509 A * 9/1979 Ueno ..... E21D 9/005 173/196
4,405,260 A * 9/1983 Tsai ..... E21D 9/005 405/138
4,422,798 A * 12/1983 Bonvoisin ..... E21D 13/00 405/132
4,647,256 A * 3/1987 Hahn ..... E21D 9/005 138/155
5,538,362 A * 7/1996 Akesaka ..... E21D 9/06 405/141
5,697,676 A * 12/1997 Kashima ..... E21D 9/08 299/60
5,749,678 A * 5/1998 Dose ..... E21B 7/208 405/146
8,393,828 B1 * 3/2013 Vidovic ..... E21D 9/005 175/61
2016/0090831 A1 * 3/2016 Malcolm ..... E21B 7/201 175/27
2017/0342834 A1 * 11/2017 Thomson ..... E21D 9/03
2019/0376252 A1 12/2019 Wang
2019/0376253 A1 12/2019 Wang
2019/0376257 A1 12/2019 Wang
2020/0095747 A1 * 3/2020 Wang ..... E02F 3/08

FOREIGN PATENT DOCUMENTS

CN 104088647 A 10/2014
CN 104695971 A 6/2015
CN 107503759 A 12/2017
CN 207048792 U 2/2018
JP H06185289 A 7/1994

* cited by examiner

II – II
Enlarged

II — II

TUNNELING DEVICE FOR PIPE JACKING AND ITS CONSTRUCTION METHOD

CLAIM FOR PRIORITY

This application is a U.S. national phase of International Application No. PCT/CN2018/072523, filed Jan. 13, 2018, titled "Tunneling Apparatus for Use in Pipe Jacking Method and Construction Method Therefor," which claims priority to CN Patent Application No. 201710039173.8, filed Jan. 18, 2017, all of which are incorporated herein by reference in their entireties.

FIELD OF THE INVENTION

The present invention relates to a tunneling device for pipe jacking and its construction method, which belongs to the field of civil engineering foundation construction.

BACKGROUND OF THE INVENTION

The current tunnel construction method includes open-cut construction and tunneling construction with pipe jacking or shield; open-cut construction features a large amount of earthwork, a long construction period and a high cost; the cost of existing tunneling construction methods is relatively high.

The existing subway stations are constructed by adopting the open-cut method. The traditional open-cut method has a relatively significant influence on the surrounding environment. The slope support is relatively difficult and the earthwork excavation is of a large amount. It is only applicable for the relatively preferred situation with open space and good geological conditions, which is of a long construction period and a high cost.

SUMMARY OF THE INVENTION

The present invention provides a tunneling device and its construction method for pipe jacking. Its object is to overcome the shortcomings of the existing technology. Its main advantages are as follows: Build working platforms in working shafts, which has less influence on the surrounding environment. The head of the first pipe joint is the excavating face of the excavating device. The excavated rock and soil are brought into the working shaft by the chain blade. The rock and soil in the pipe joint are removed after the pipe joint is pushed in place. It is of simple construction, good quality, a short construction period, and a low cost.

The Technical Scheme of the Invention: A tunneling device for pipe jacking is characterized in consisting of an excavating device, a head front-end track, a middle-section track and a rear device. The excavating device consists of a transmission device and a chain blade. The transmission device consists of a driving device and a chain blade. The chain blade consists of a chain and a blade fixed on the chain. During construction of the head front-end track and the middle-section track, there is chain blade operating to excavate rock and soil. The tail of the head front-end track integrates with the front end of the first section of pipe, and the head is of the same shape to the cross section of the pipe joint; the rear device includes a jacking device installed in the construction well; the front end of the middle-section track is connected to the head front-end track, and the tail end of the middle-section track to the rear device. The middle-section track is located outside or inside the pipe joint. The driving device drives the chain blade, which operates along the track. The blade on the head front-end track excavates the annular rock and soil on the projected part of the cross section of the pipe joint. The rock and soil excavated are brought back by the chain blade operating backwards on the middle-section track. The excavating device is equipped with a mud pipeline with nozzles on its end.

The pipe jacking construction method includes the following steps:

1) Excavate working shafts and build working platforms;
2) Install the rear device in working shaft;
3) Connect and fix the first pipe joint and the head front-end track, and install the chain blade on the track;
4) Install the middle-section track;
5) Install the transmission device consisted of the driving device the chain wheels, to form an excavating device;
6) Install the jacking device;
7) Drive the chain. The chain blade on the front track excavates rock and soil on front and brings it to the rear. The jacking device pushes the tail end of the pipe joint or the jacking driving device. And, the driving device pushes the end of the pipe joint to move the pipe joint forwards;
8) After jacking the first pipe joint through the specified distance, the jacking device retracts. Lower the second pipe joint, and connect the head of the second pipe joint to the end of the first pipe joint;
9) Install the chain blade on the track of the second pipe joint to form the excavating device. The chain blade excavates the rock and soil in front of the first pipe joint. The jacking device pushes the end of the pipe joint or the driving device, and the pipe joint moves forward;
10) Repeat the above actions, complete the construction of the entire pipe joint, and excavate rock and soil in the pipe joint after partial or total completion of pipe joint jacking construction;

2), 3), 4), 5) and 6) actions are listed in no particular order.

The construction method is the construction method of the subway station, including the steps below:

I. Build working shaft outside the subway station;

II. Build a tunnel perpendicular to the longitudinal direction of the station in the working shaft;

1) Install the rear device in working shaft;
2) Connect and fix the first pipe joint and the head front-end track, and install the chain blade on the track;
3) Install the middle-section track;
4) Install the transmission device consisting of the driving device and the tensioning device, etc., to form an excavating device;
5) Install the jacking device;
6) Drive the chain. The chain blade excavates the annular rock and soil on the projected part in front of the head and brings it to the rear. The jacking device pushes the pipe joint, to move the pipe joint forwards;
7) After jacking the first pipe joint through the specified distance, the jacking device retracts. Lower the second pipe joint, and connect the front end of the second pipe joint to the end of the first pipe joint;
8) The jacking device pushes the pipe joint, and the chain blade excavates the rock and soil in front of the head. The jacking device pushes the pipe joint to move the pipe joint forwards;
9) Repeat the above actions, complete the construction of the entire pipe joint, and excavate rock and soil in the pipe joint after partial or total completion of pipe joint jacking construction;

1), 2), 3), 4) and 5) actions listed in no particular order.

III. Build subway stations in a built tunnel

1) Install the rear device in built tunnels;

2) Connect and fix the first pipe joint and the head front-end track, and install the chain blade on the track;

3) Install the middle-section track;

4) Install the transmission device consisting of the driving device and the tensioning device, etc., to form an excavating device;

5) Install the jacking device;

6) Drive the chain. The chain blade excavates the annular rock and soil on the projected part in front of the head and brings it to the rear. The jacking device pushes the pipe joint, to move the pipe joint forwards;

7) After jacking the first pipe joint through the specified distance, the jacking device retracts. Lower the second pipe joint, and connect the front end of the second pipe joint to the end of the first pipe joint;

8) The jacking device pushes the pipe joint, and the chain blade excavates the rock and soil in front of the head, the jacking device/the jacking pipe joint and the pipe joint moves forwards;

9) Repeat the above actions, complete the construction of the entire pipe joint, and excavate rock and soil in the pipe joint after partial or total completion of pipe joint jacking construction;

1), 2), 3), 4) and 5) actions are listed in no particular order.

The advantages of the present invention: Build working platforms in a working shaft, which has less influence on the surrounding environment. The head of the first pipe joint is the excavating face of the excavating device. The excavated rock and soil are brought into the working shaft by the chain blade. The rock and soil in the pipe joint are removed after the pipe joint is pushed in place. It is of simple construction, good quality, a short construction period, and a low cost.

It is also a structure schematic diagram of the space-bending of chain 5-1. (b) is a structure schematic diagram of chain blade 5 consisting of flexible belt 5-1B and blade 5-2B, and a structure schematic diagram of flexible belt 5-1B and blade 5-2B.

Figure 1:
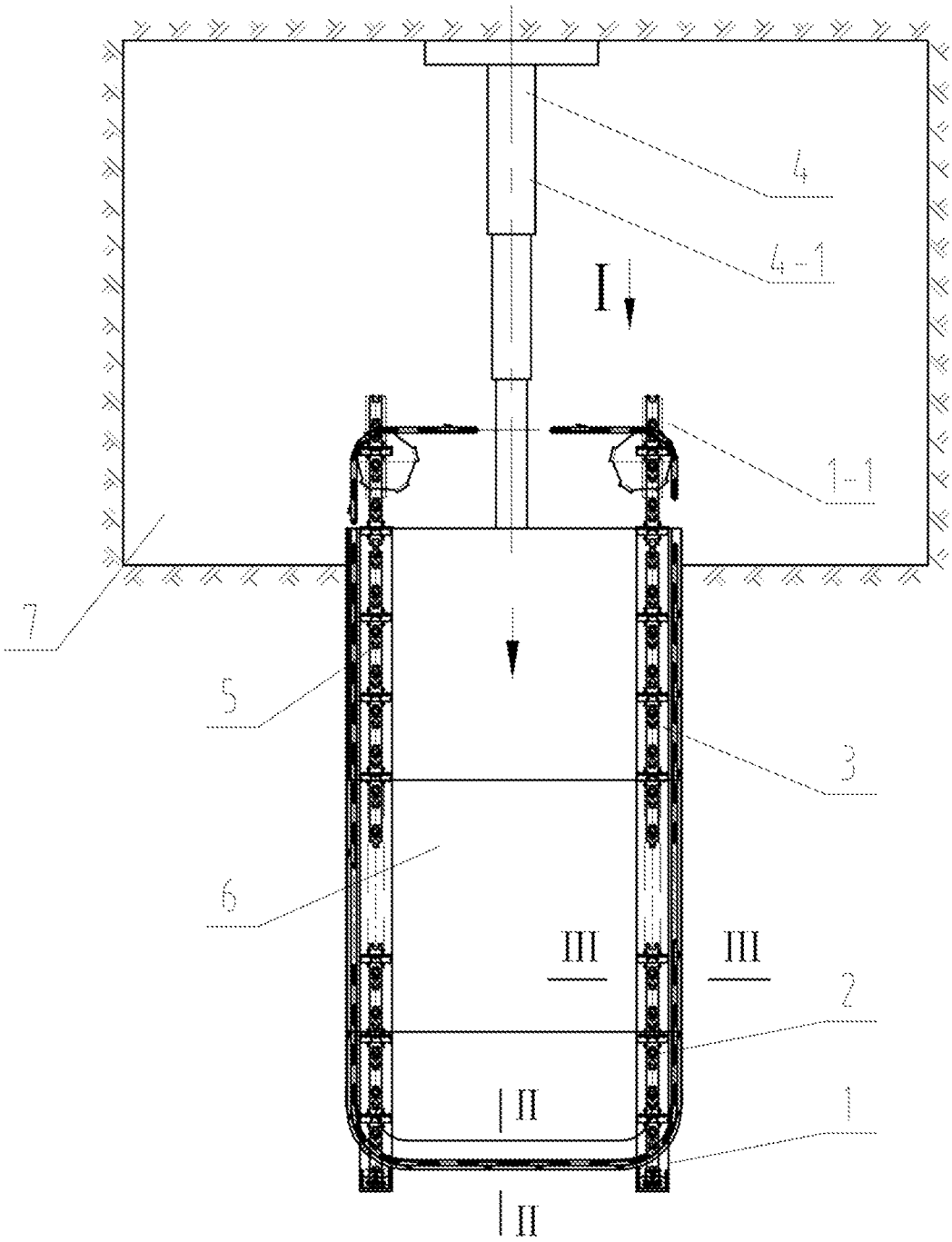
FIG. 1 is a construction schematic diagram of tunneling device in working shaft 7, which is also a schematic structure diagram of excavating device 1, head front-end track 2, middle-section track 3, rear device 4, chain blade 5 and pipe joint 6 that constitute tunneling device. It is also a schematic diagram for the jacking of pipe joint 6 by jacking device 4-1 while the excavating device 1 is excavating rock and soil.
Figure 2:
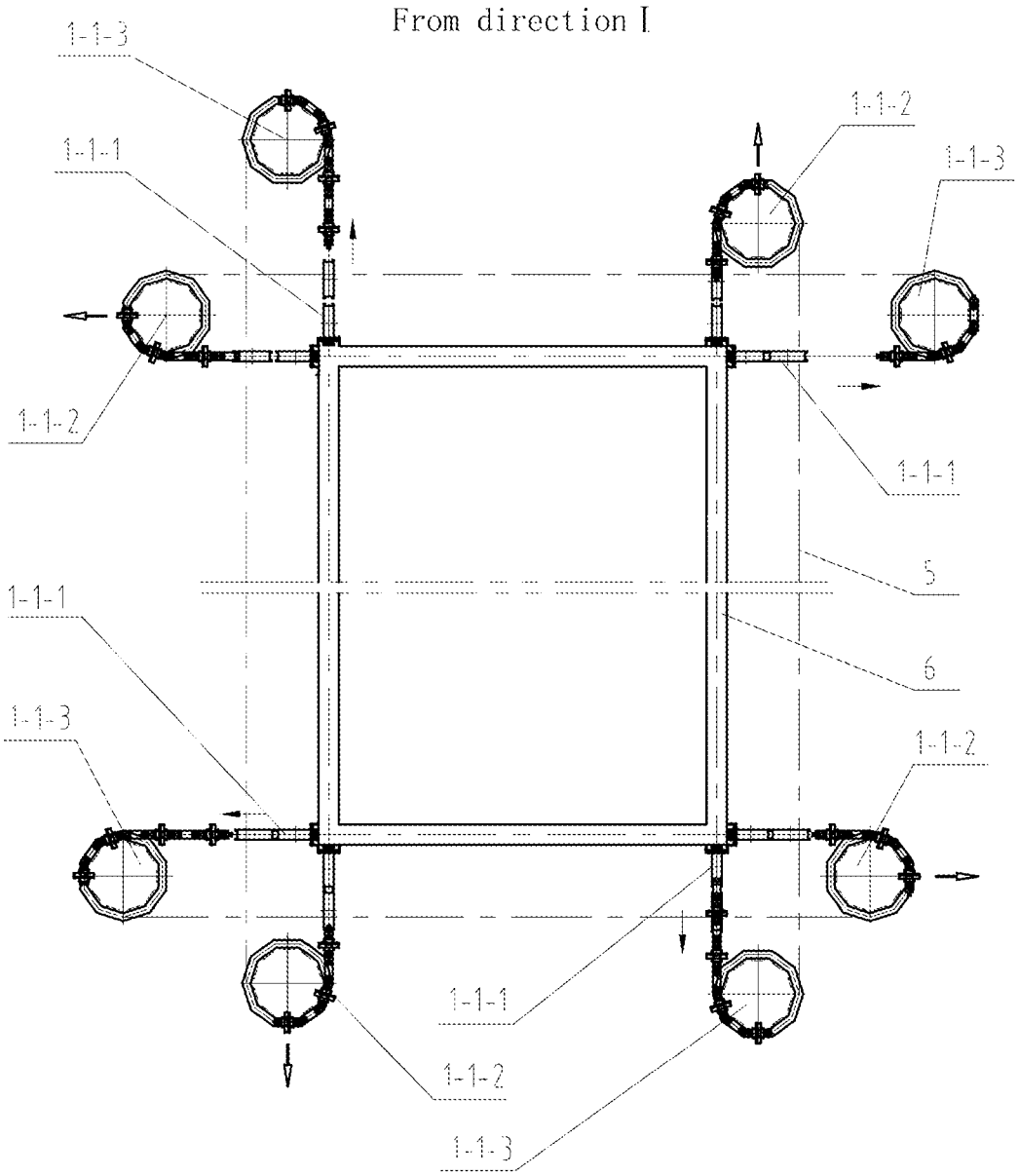
FIG. 2 is the I-view of FIG. 1, and a structural schematic diagram of the excavating device 1, which consists of transmission device 1-1 and chain blade 5. It is also a structural schematic diagram of drive device 1-1-1, tensioning device 1-1-2 and chain wheel 1-1-3 constituting the transmission device 1-1.
Figure 3:
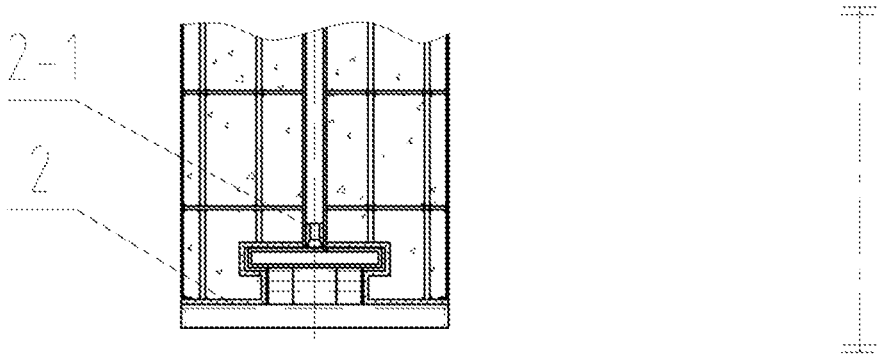
FIG. 3 is a II-II view of FIG. 1, and a structural schematic diagram of the slurry pipeline 2-1 on head front-end track 2.
Figure 4:
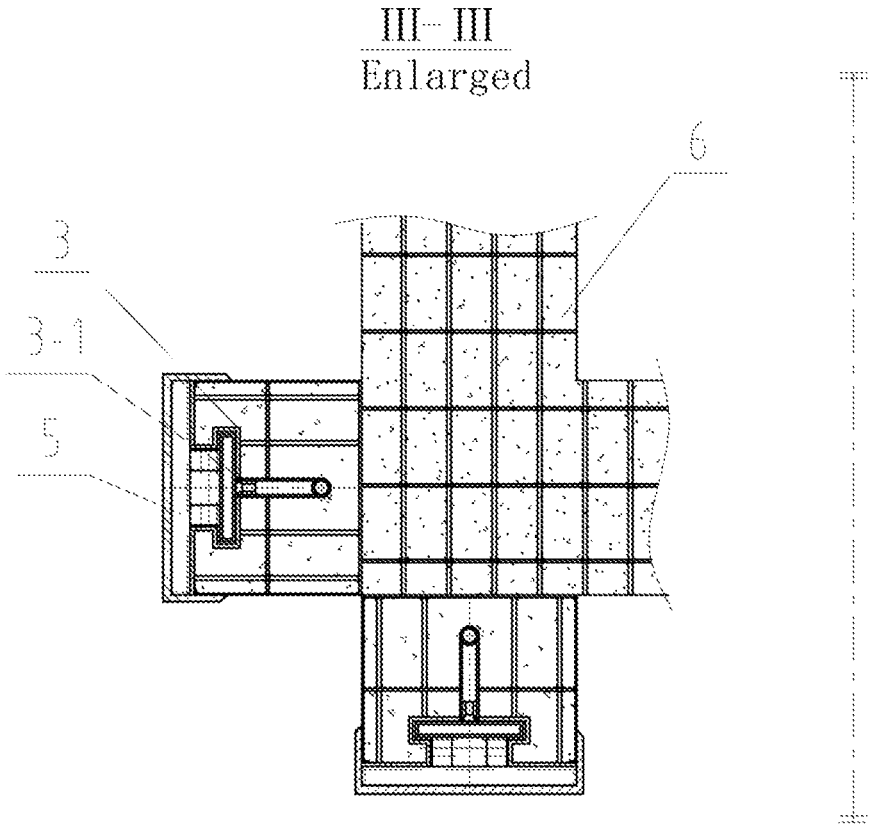
FIG. 4 is the III-Ill view of FIG. 1. It is also a structure schematic diagram of slurry pipeline 3-1 of middle-section track 3 and a schematic diagram of middle-section track 3 fixed on pipe joint 6.
Figure 5:
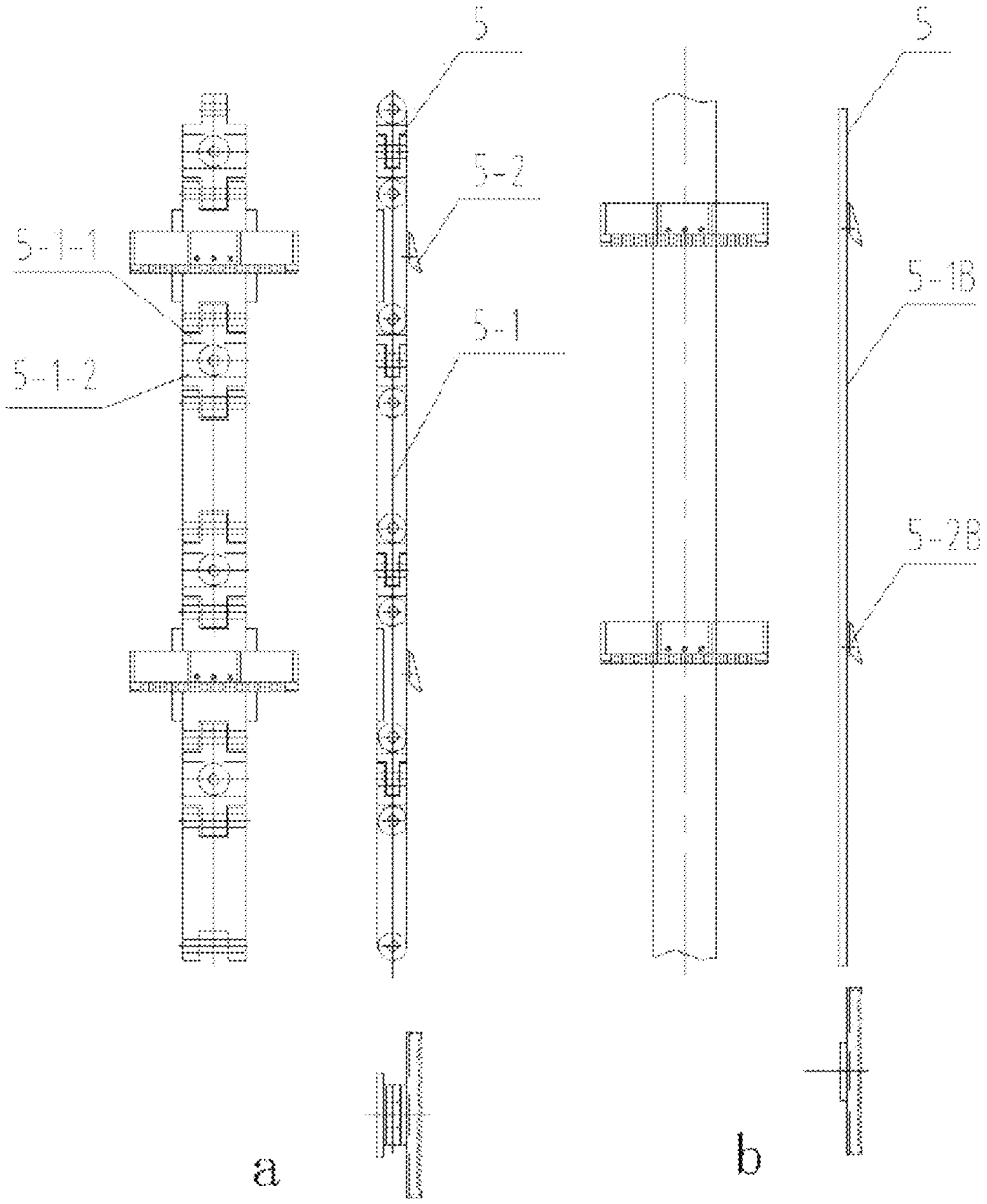
FIG. 5 is a structure schematic diagram of chain blade 5, a structure schematic diagram of chain 5-1 and blade 5-2, as well as a structure schematic diagram of the cross of chain 5-1 consisting of A cross 5-1-1 and B cross 5-1-2. It is also a structure schematic diagram of blade 5-1 for the spatial bending and a structure schematic diagram of chain blade 5. (a) is a structure schematic diagram of chain 5-1 and blade 5-2, and a structure schematic diagram of A cross 5-1-1 and B cross 5-1-2 consisted of the cross of chain 5-1.
Figure 6:
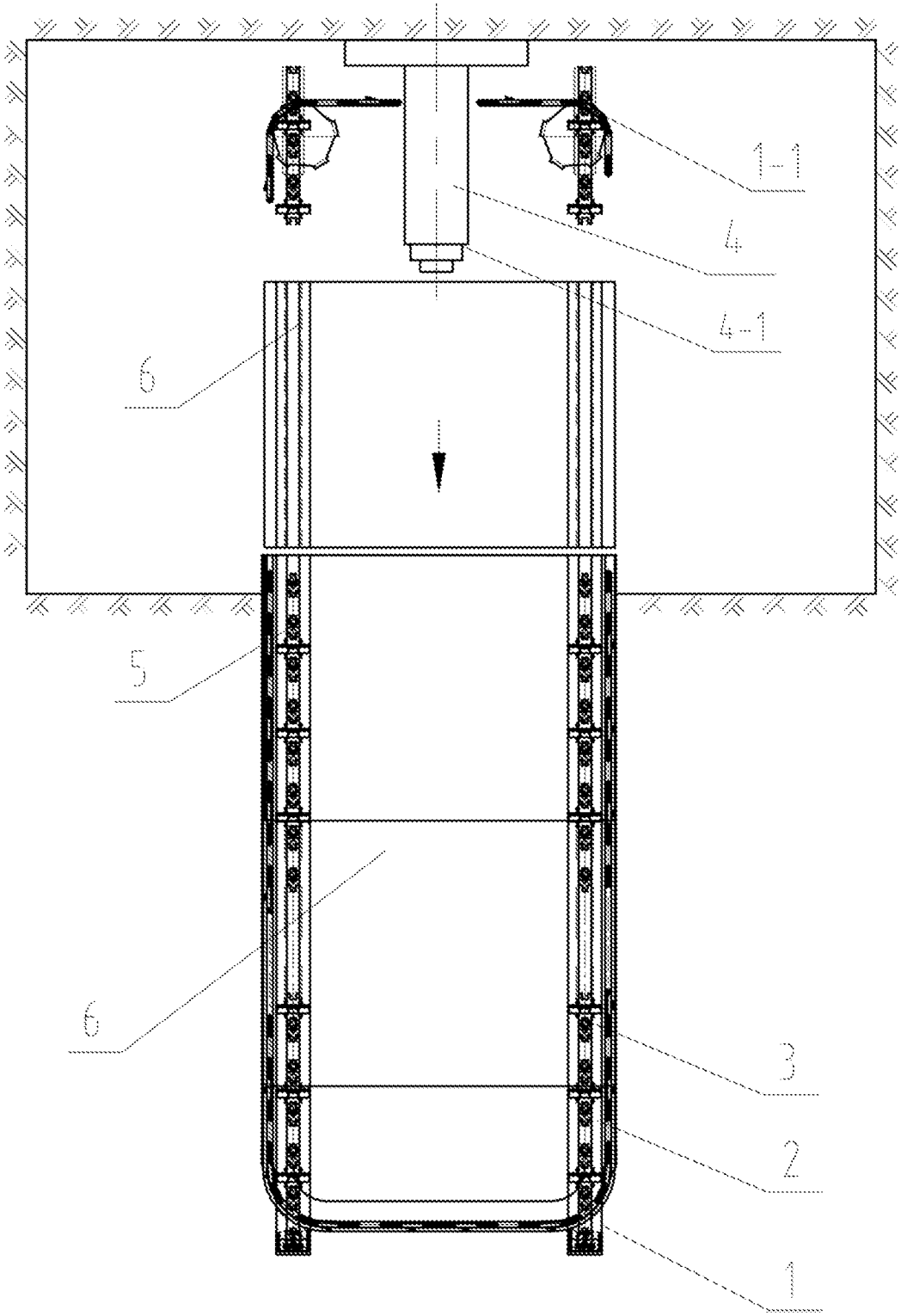

FIG. 6 is a schematic diagram of the status of the pipe joint 6 placed in the working shaft. The jacking device 4-1 of the rear device 4 retracts to disconnect the chain blade 5-1, and the transmission device 1-1 of the excavating device 1 retracts to lay the next pipe joint 6.

Figure 7:
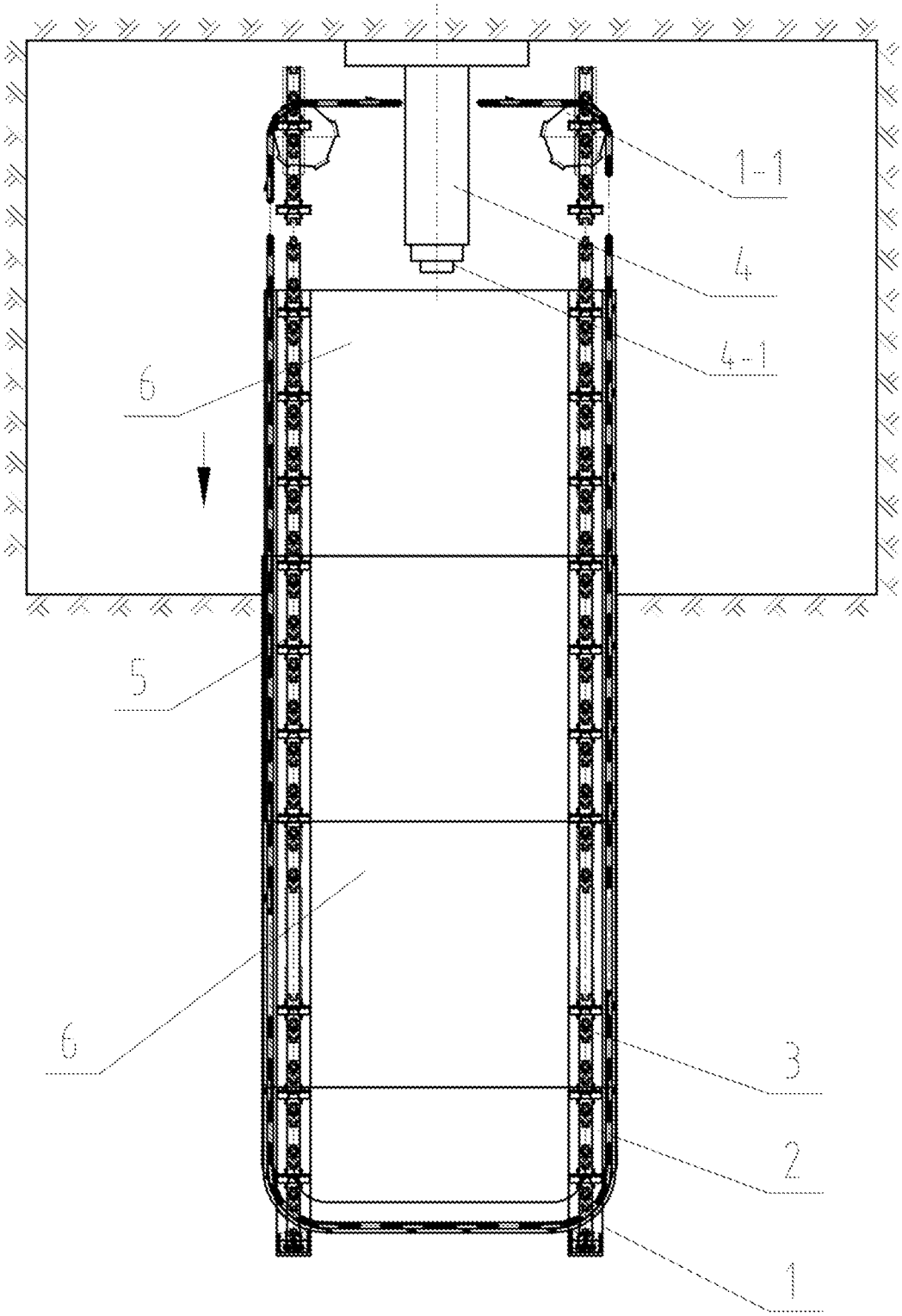

FIG. 7 is the next working procedure status diagram of FIG. 6, which is also the status diagram of the installation pipe joint 6 and the connecting chain 5-1. Fix the installation pipe joint 6 to the previous pipe joint, install the middle-section track 3, and connect the chain 5-1 of chain blade 5 and drive chain 5-1. Chain blade 5 excavates the annular rock and soil of the projected part of the head, and brings it to the rear. Jacking device 4-1 pushes the pipe joint 6 to move forwards.

Figure 8:
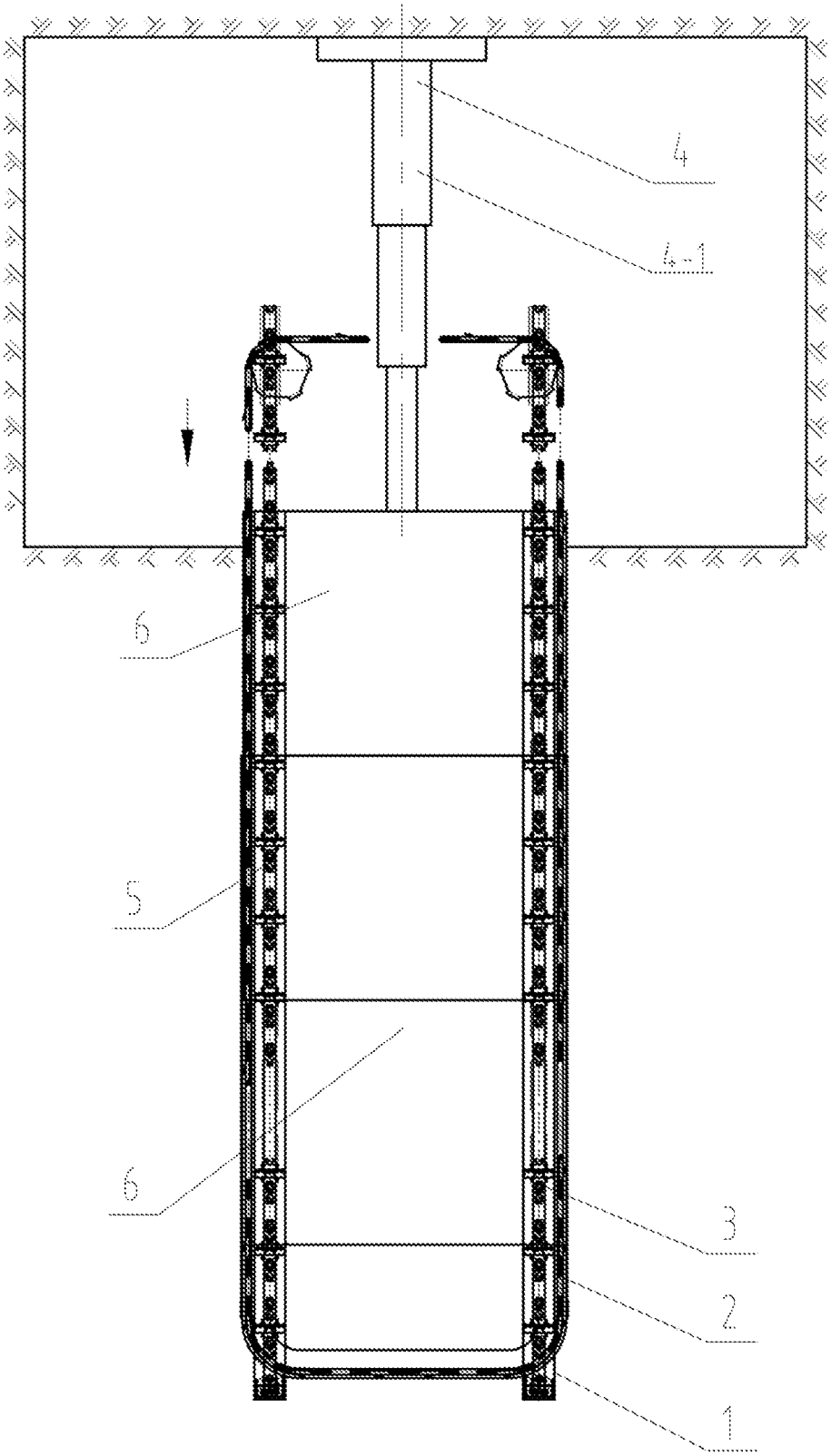

FIG. 8 is a status diagram of the next working process of FIG. 7, and also a status diagram for the proper jacking of pipe joint 6.

Figure 9:
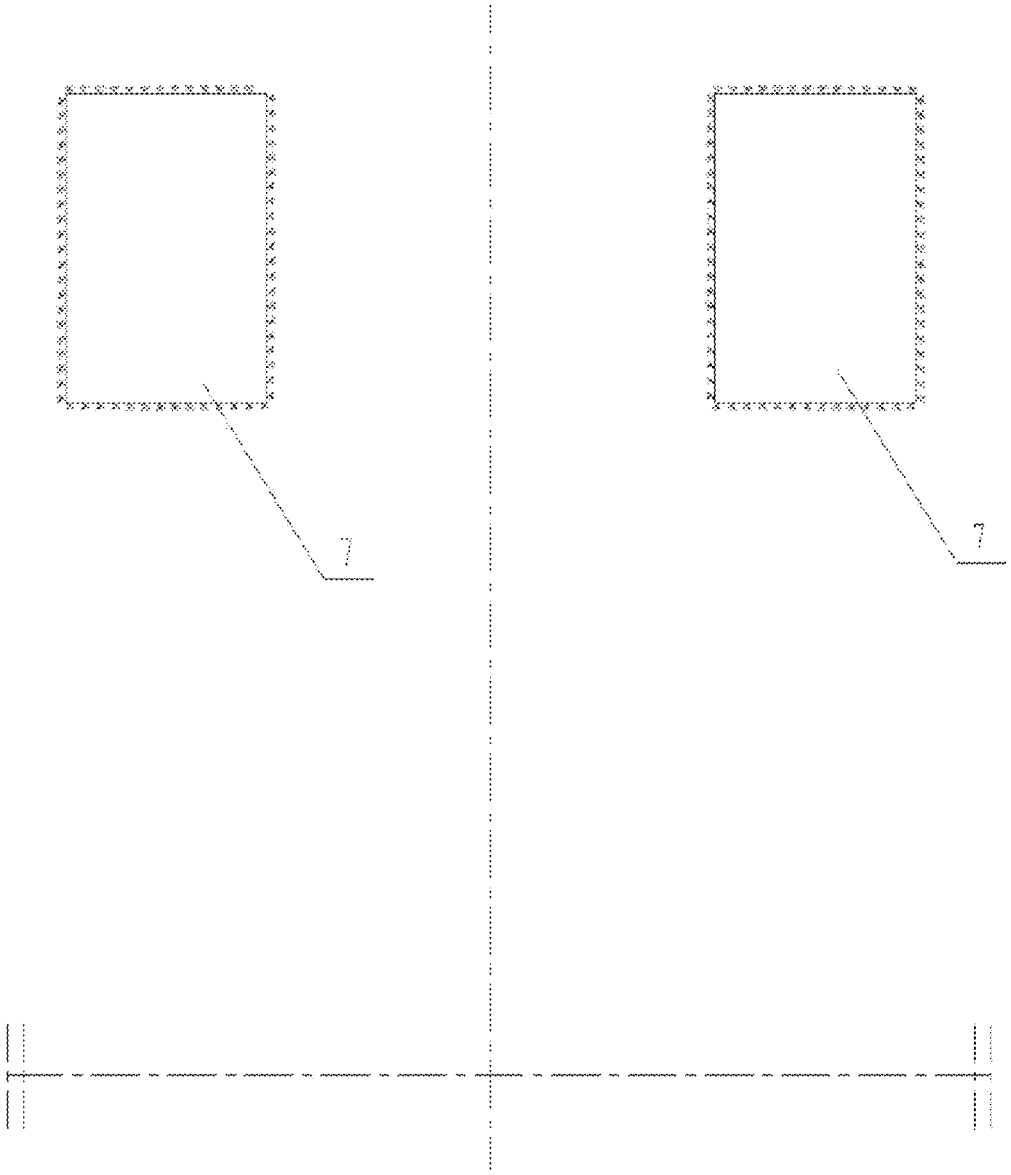

FIG. 9 is a schematic diagram of working shaft 7 built outside the subway station.

Figure 10:
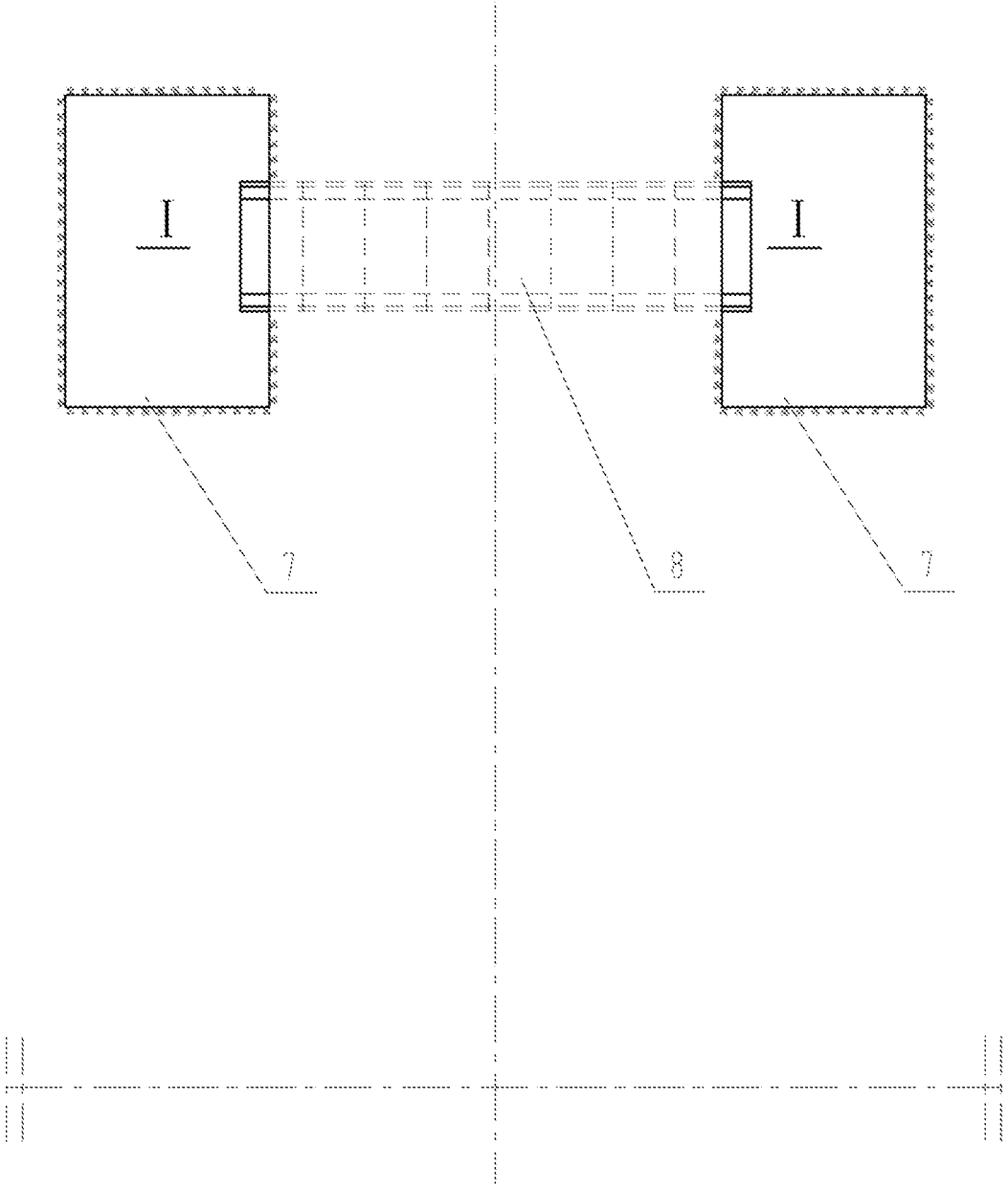

FIG. 10 is a schematic diagram of tunnel 8 built in working shaft 7 perpendicular to the longitudinal direction of the subway station.

Figure 11:
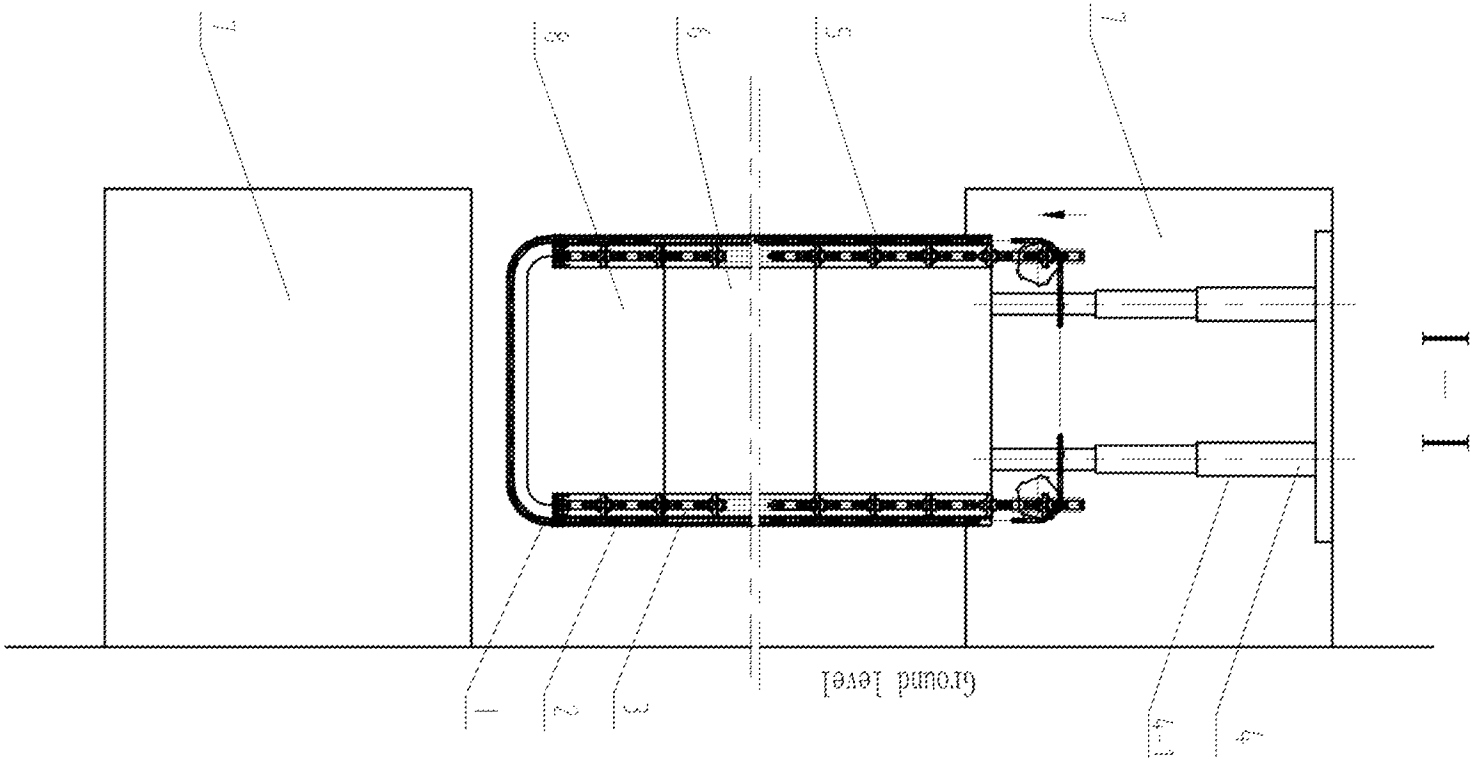

FIG. 11 is the I-I view of FIG. 10. It is also a schematic diagram for the jacking of jacking device 4-1 realized by the excavation of annular rock and soil on the projected part on the cross-section of the tunnel by blade 5-2 on the head front-end track 2 of tunnel 8.

Figure 12:
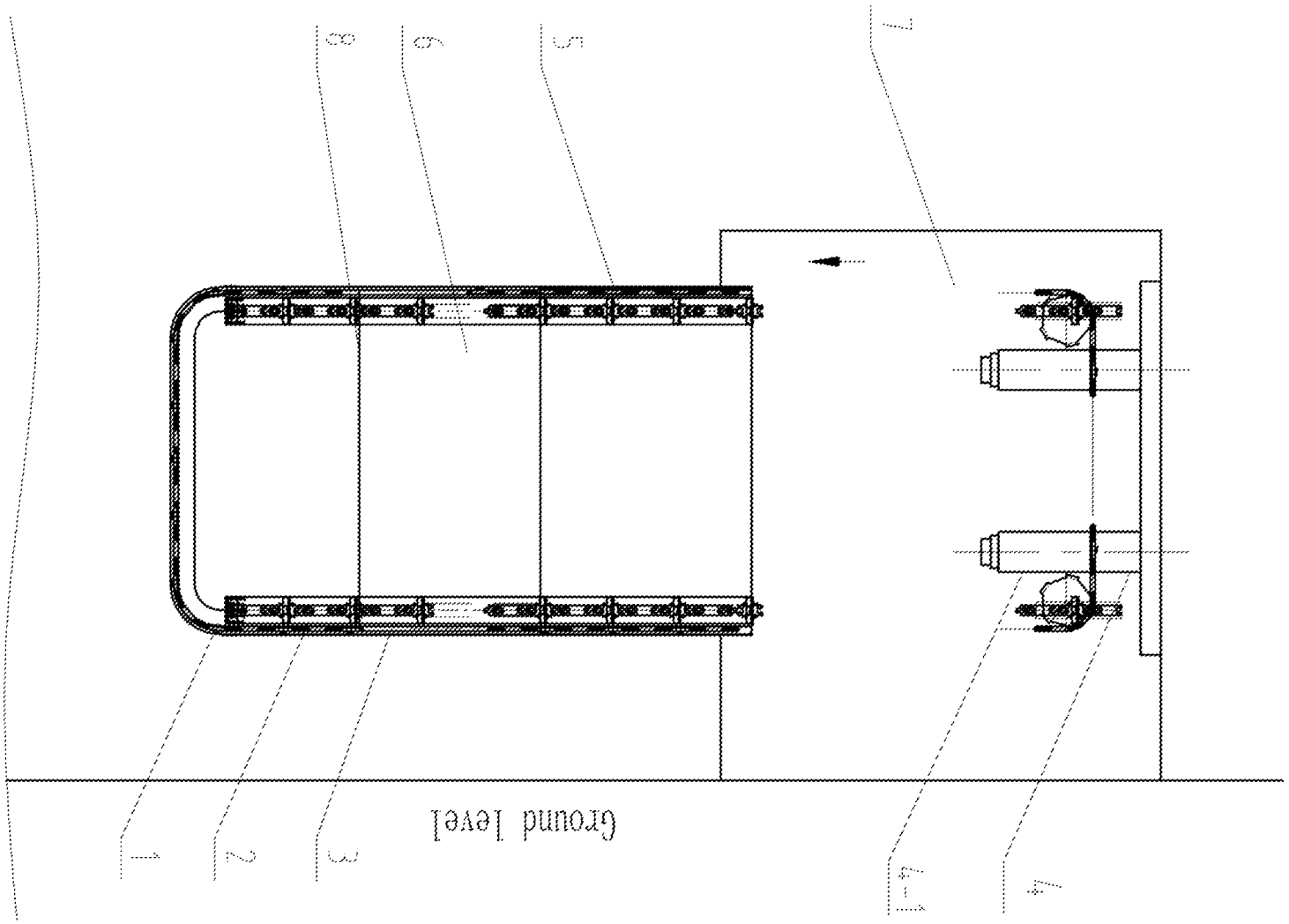

FIG. 12 is a structure schematic diagram to indicate that the jacking device 4-1 of the rear device 4 retracts to disconnect the chain 5-1 of chain blade 5, and the transmission device 1-1 of the excavating device 1 retracts.

Figure 13:
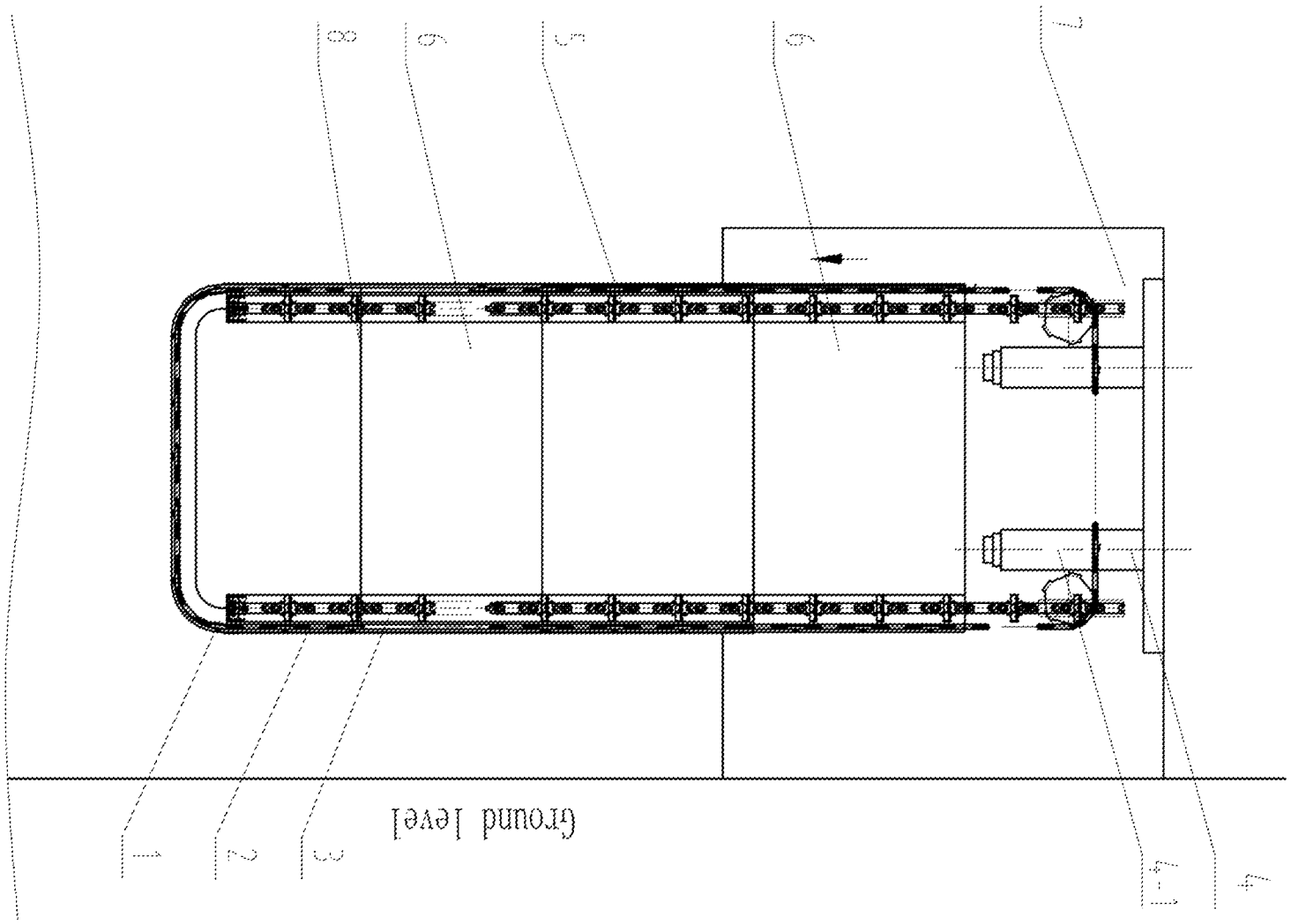

FIG. 13 is the status schematic diagram of the next working process of FIG. 12. A new pipe joint 6 is laid, connected and fixed to the previous pipe joint. Install the middle-section track 3, and connect the chain 5-1 and the driving chain 5-1 consisted of chain blade 5.

Figure 14:
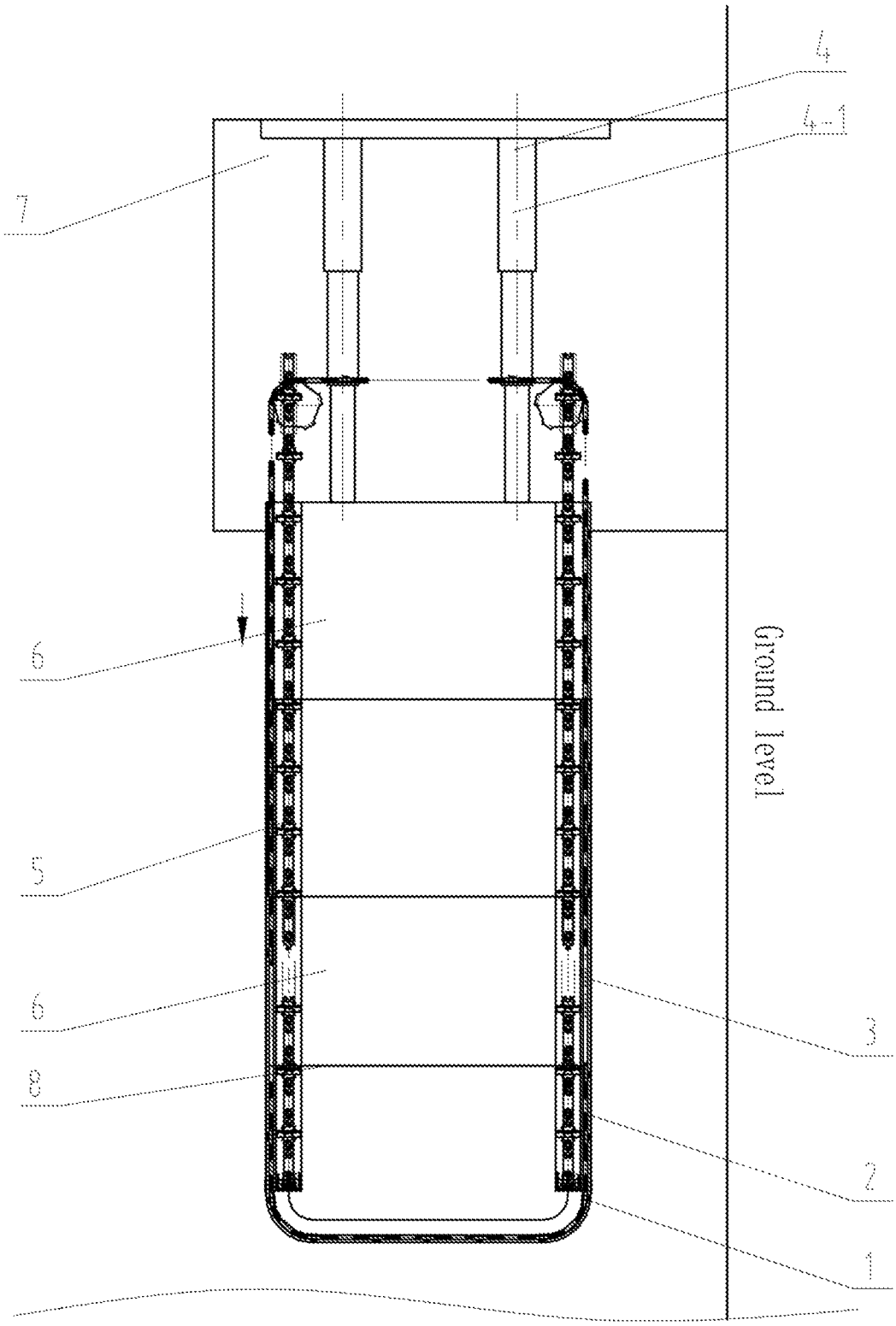

FIG. 14 is the status schematic diagram of the next working process of FIG. 13. It is also the status schematic diagram for jacking of pipe joint 6 by jacking device 4, and for the rock and soil in front of the head excavated by chain blade 5.

Figure 15:
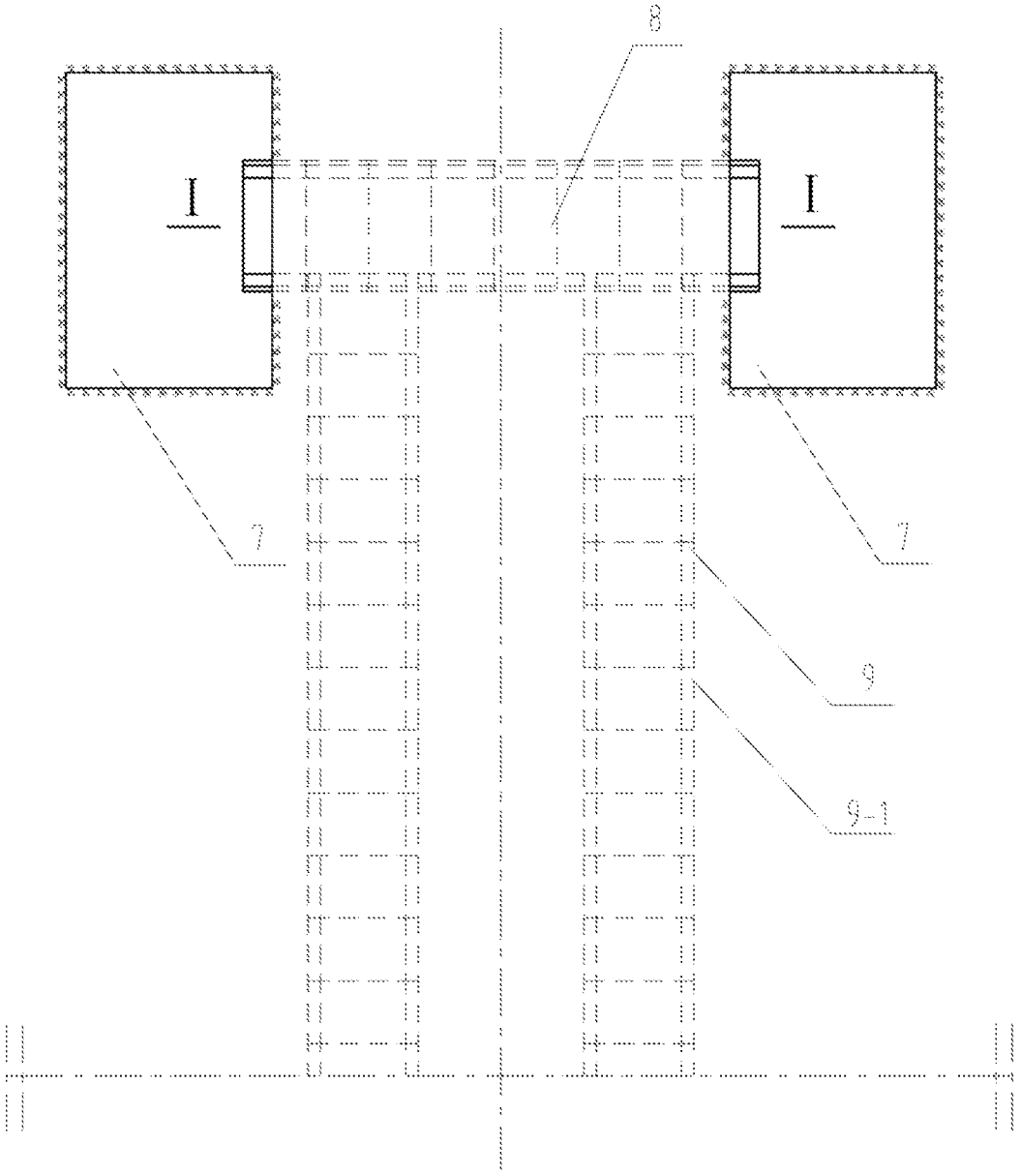

FIG. 15 is a schematic diagram of the square-shaped pipe joint 9-1 of the subway station in the built tunnel 8.

Figure 16:
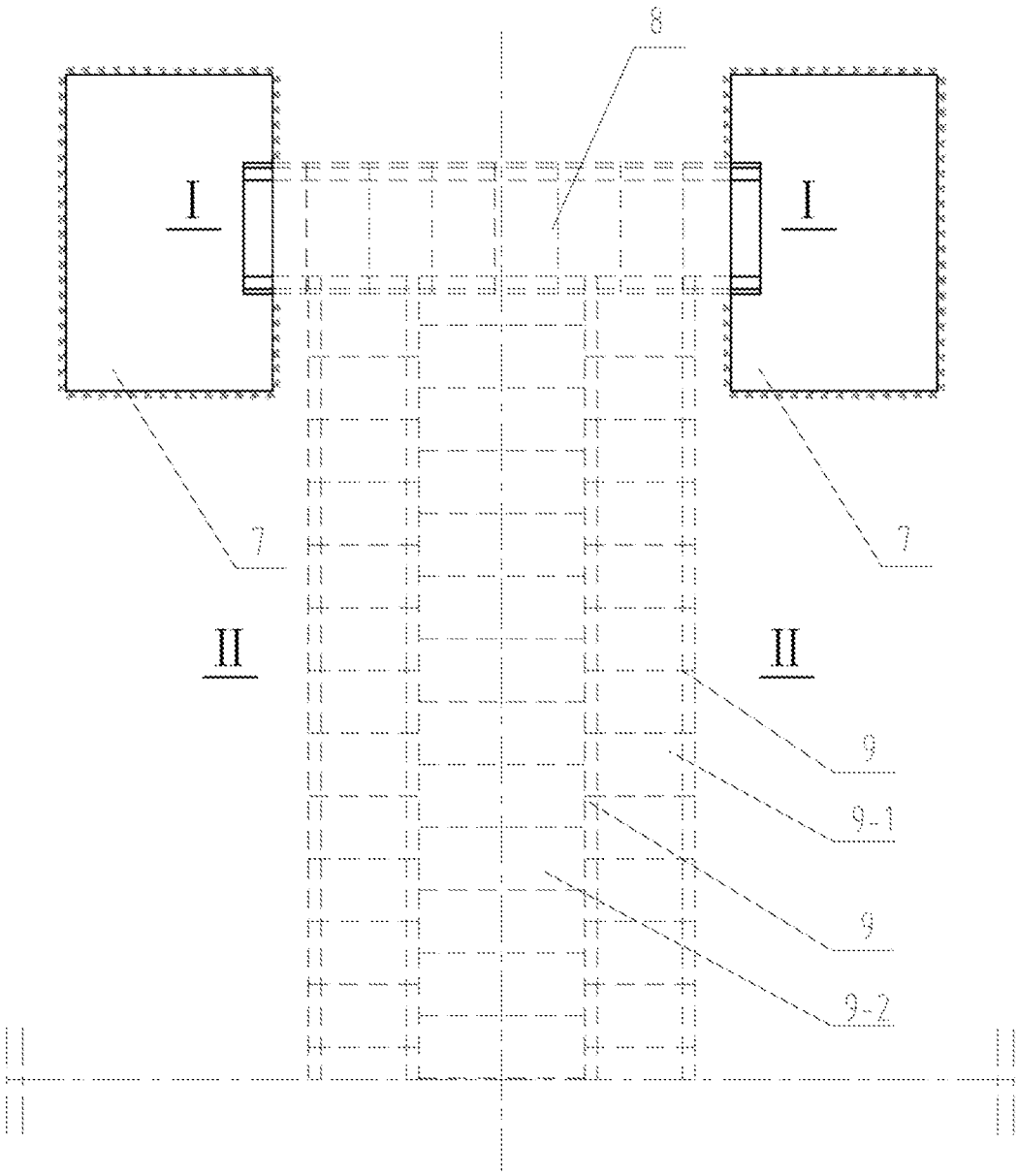

FIG. 16 is a schematic diagram of slotted pipe joints 9-2 and 9-3 on upper middle and lower middle parts of the construction respectively in the middle of the tunnel formed by square-shaped pipe joint 9-1 on both sides in the built tunnel 8.

Figure 17:
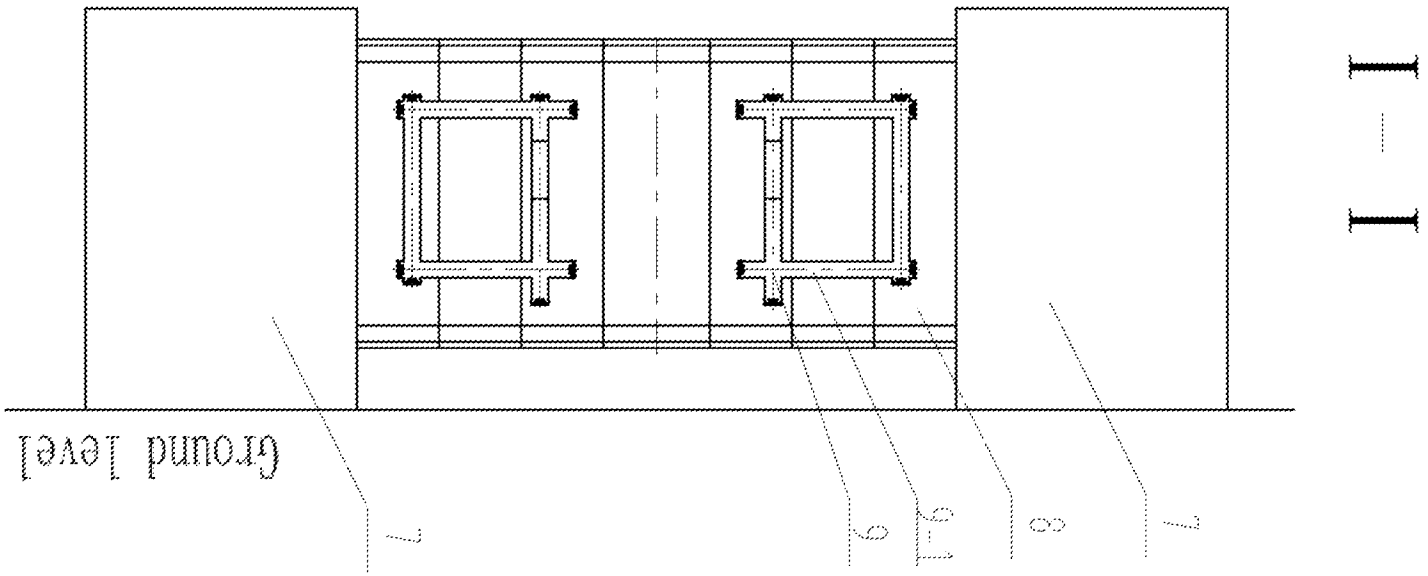

FIG. 17 is the I-I view of FIG. 15. It is also a schematic diagram of the previous construction of the two pipe joints 9-1 on both sides along the transversal direction of subway station 9.

Figure 18:
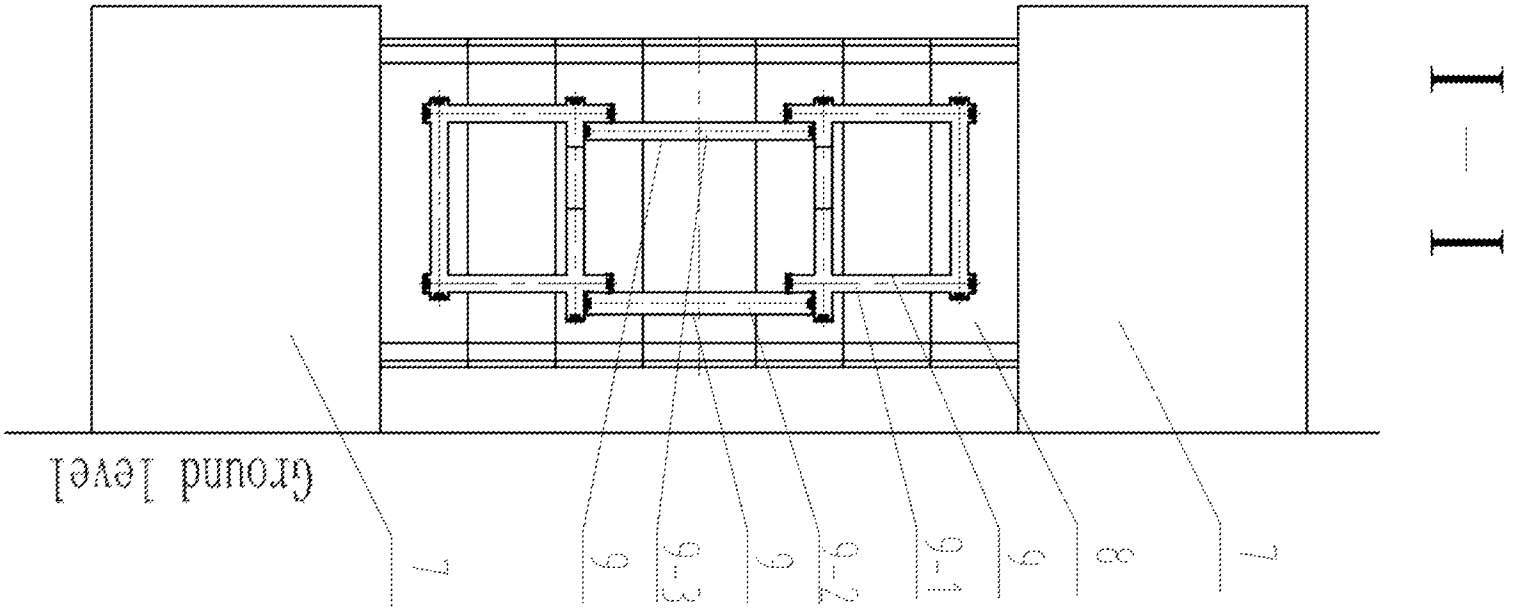

FIG. 18 is the I-I view of FIG. 16. It is also a structural schematic diagram of cross-section of subway station tunnel 9, which consists of a square-shaped pipe joint 9-1 on both sides, a slotted pipe joints 9-2 and 9-3 on the upper middle and lower middle parts respectively.

Figure 19:
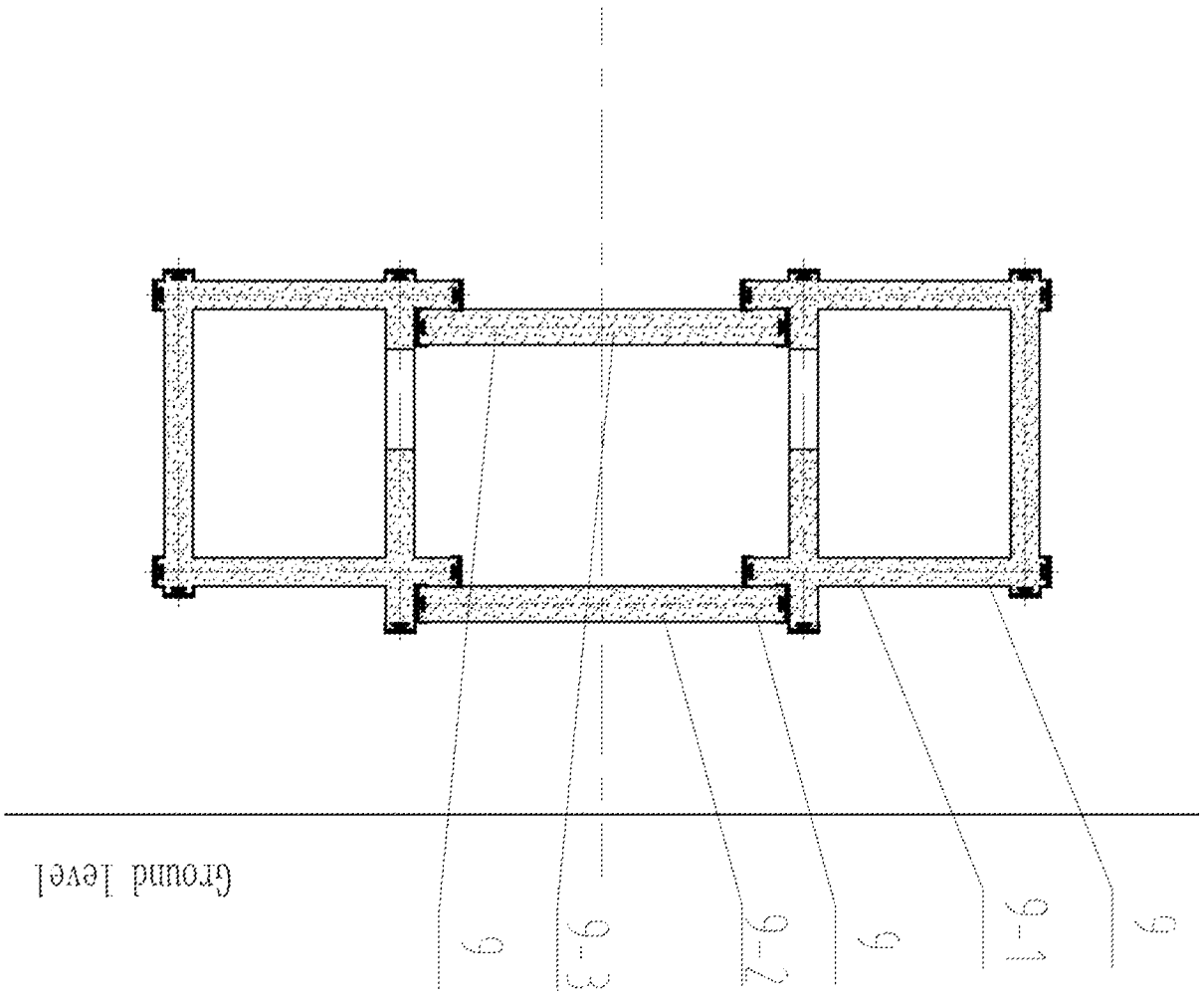

FIG. 19 is a II-II view of FIG. 16.

Figure 20:
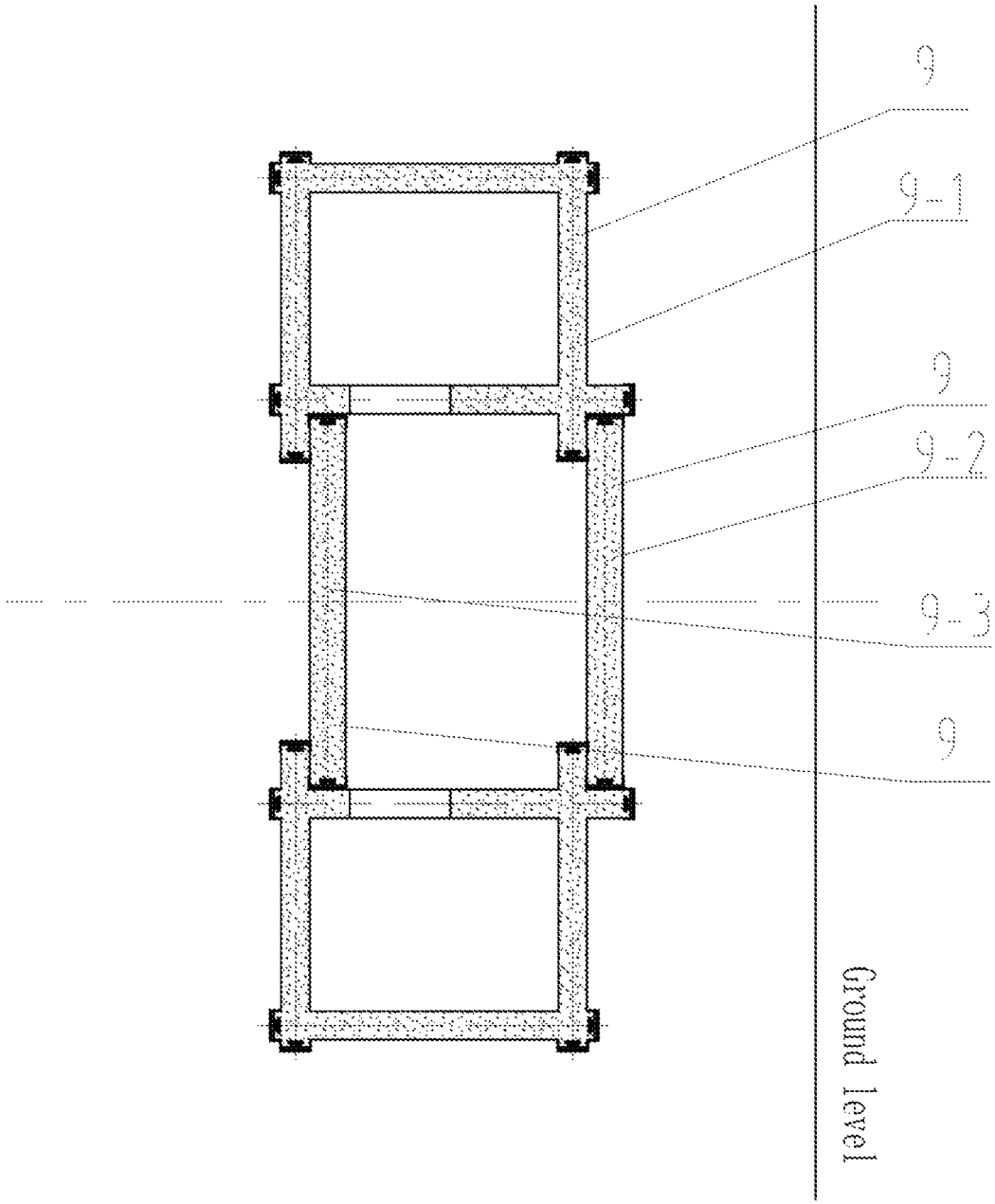

FIG. 20 is the status diagram of the next working process of FIG. 19, and also a structural schematic diagram showing the status after removal of rock and soil in the subway station tunnel 9.

Figure 21:
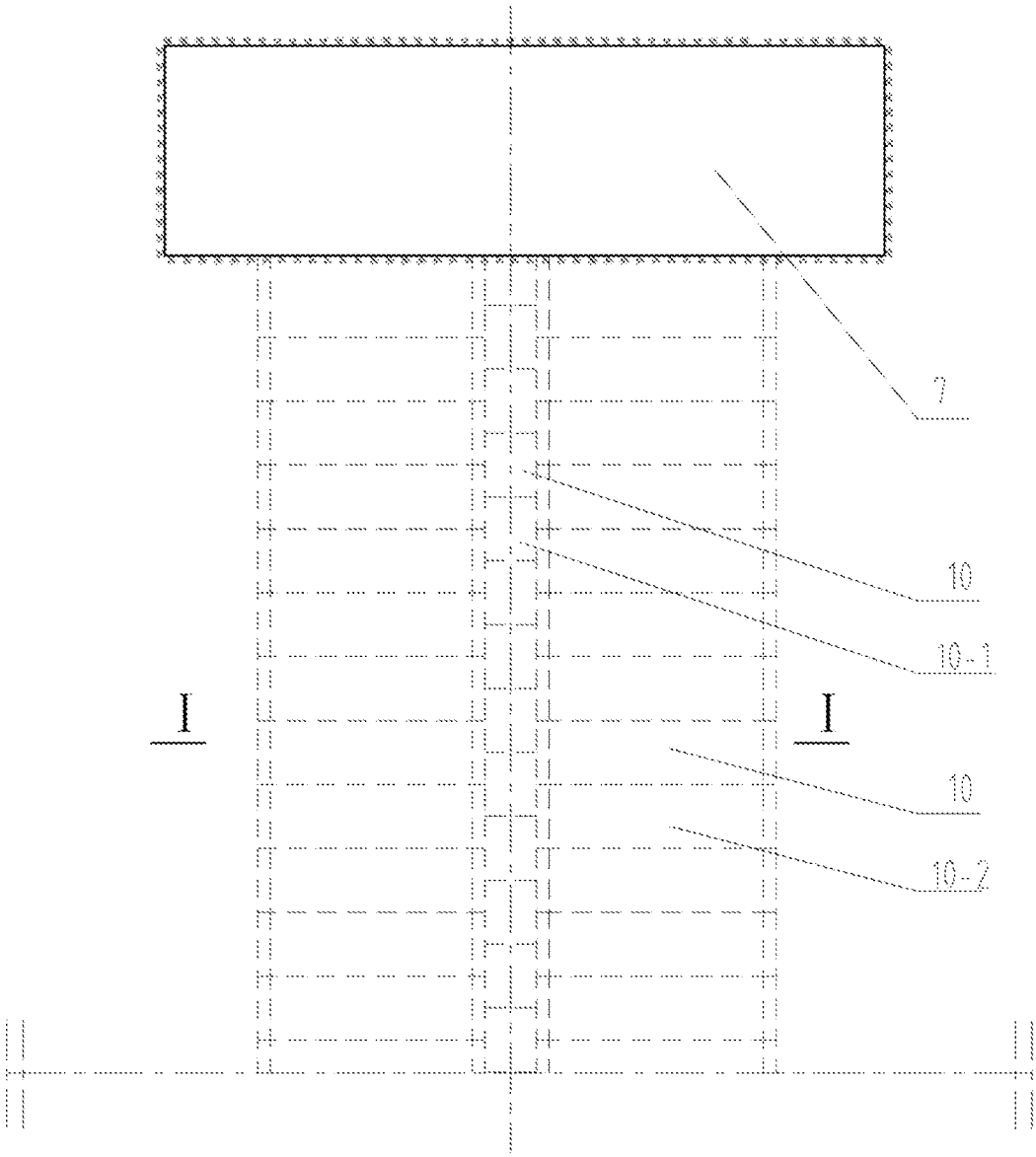

FIG. 21 is the structural schematic diagram of tunnel 10 in working shaft 7.

Figure 22:
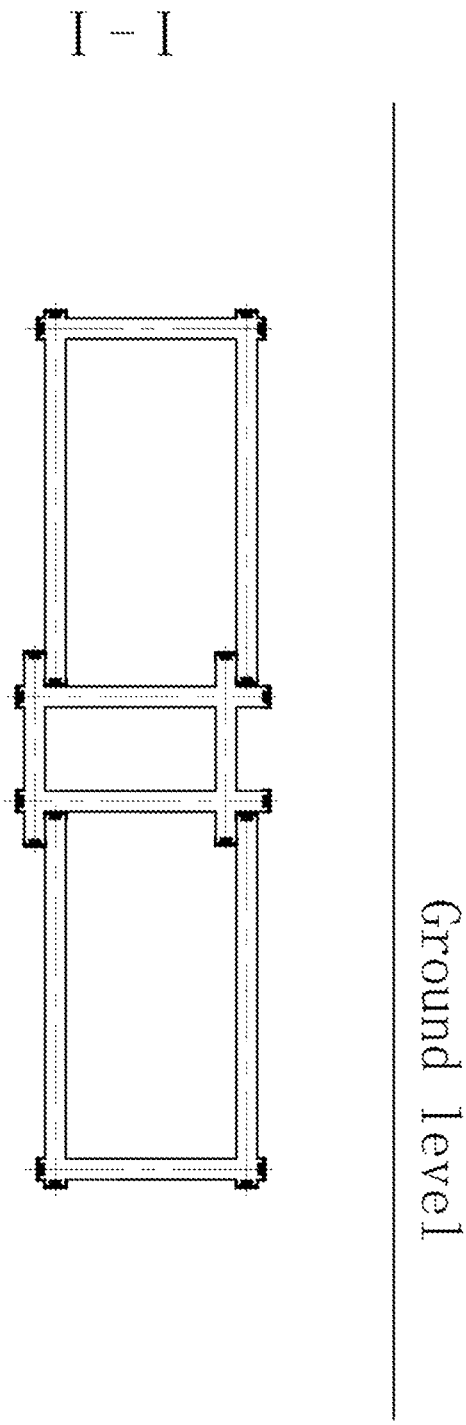

FIG. 22 is the I-I view of FIG. 21, and also the structural schematic diagram of the square-shaped pipe joint 10-1 in the middle and the U-shaped pipe joint 10-2 on both sides.

Figure 23:
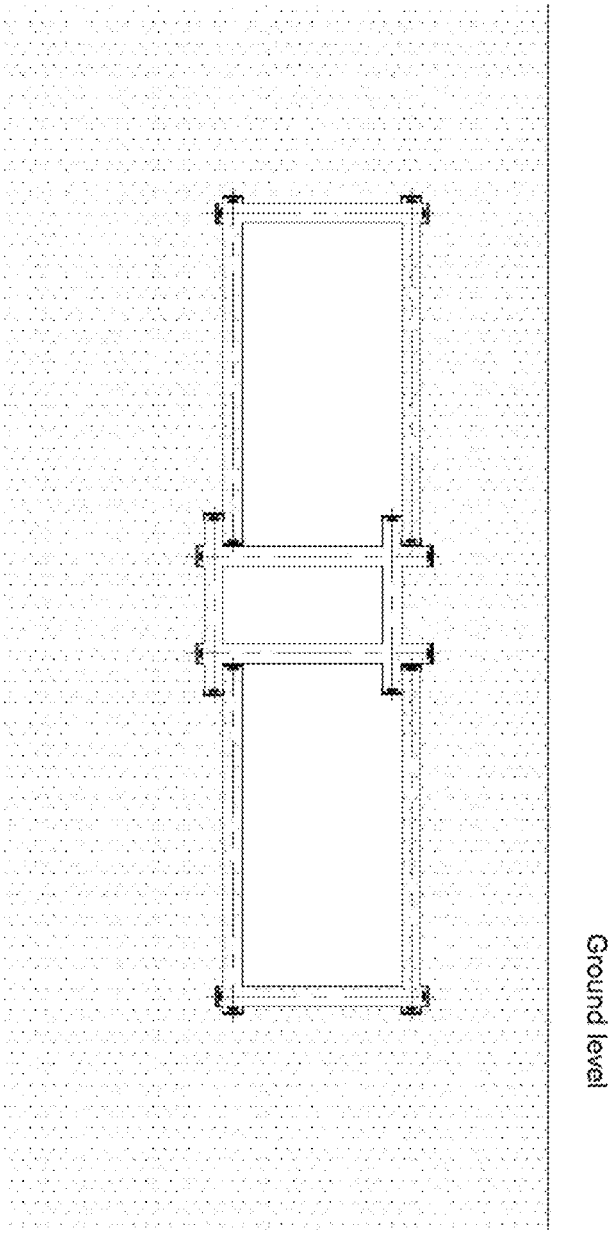

FIG. 23 is the status diagram of the next working process of FIG. 22, and also the structure schematic diagram of tunnel 10 after removal of rock and soil.

Figure 24:
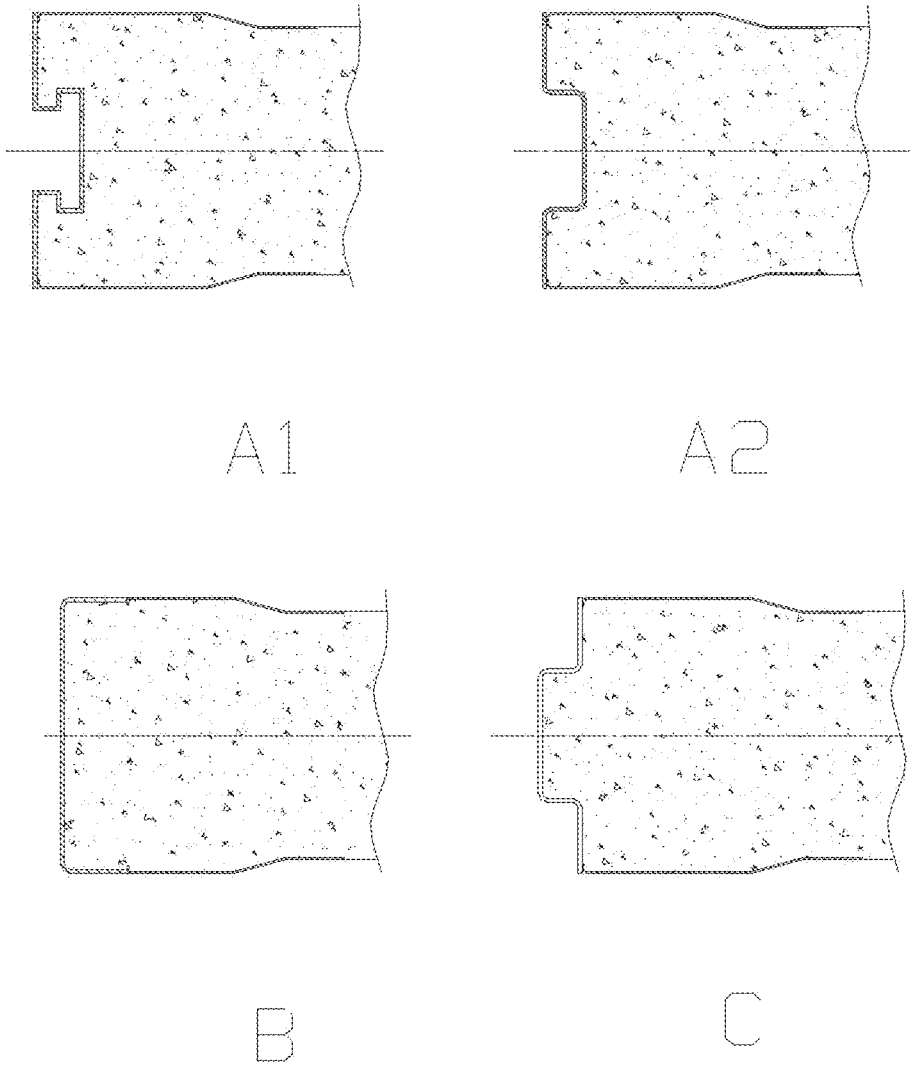

FIG. 24 is the schematic diagram of the chain blade track on the bottom and the chain blade track on both sides of tunneling device 1. There are five types of tracks, including A1, A2, B, C and D. Among them, A1, A2 are of concave type, B of plane type and C of convex type.

Figure 25:
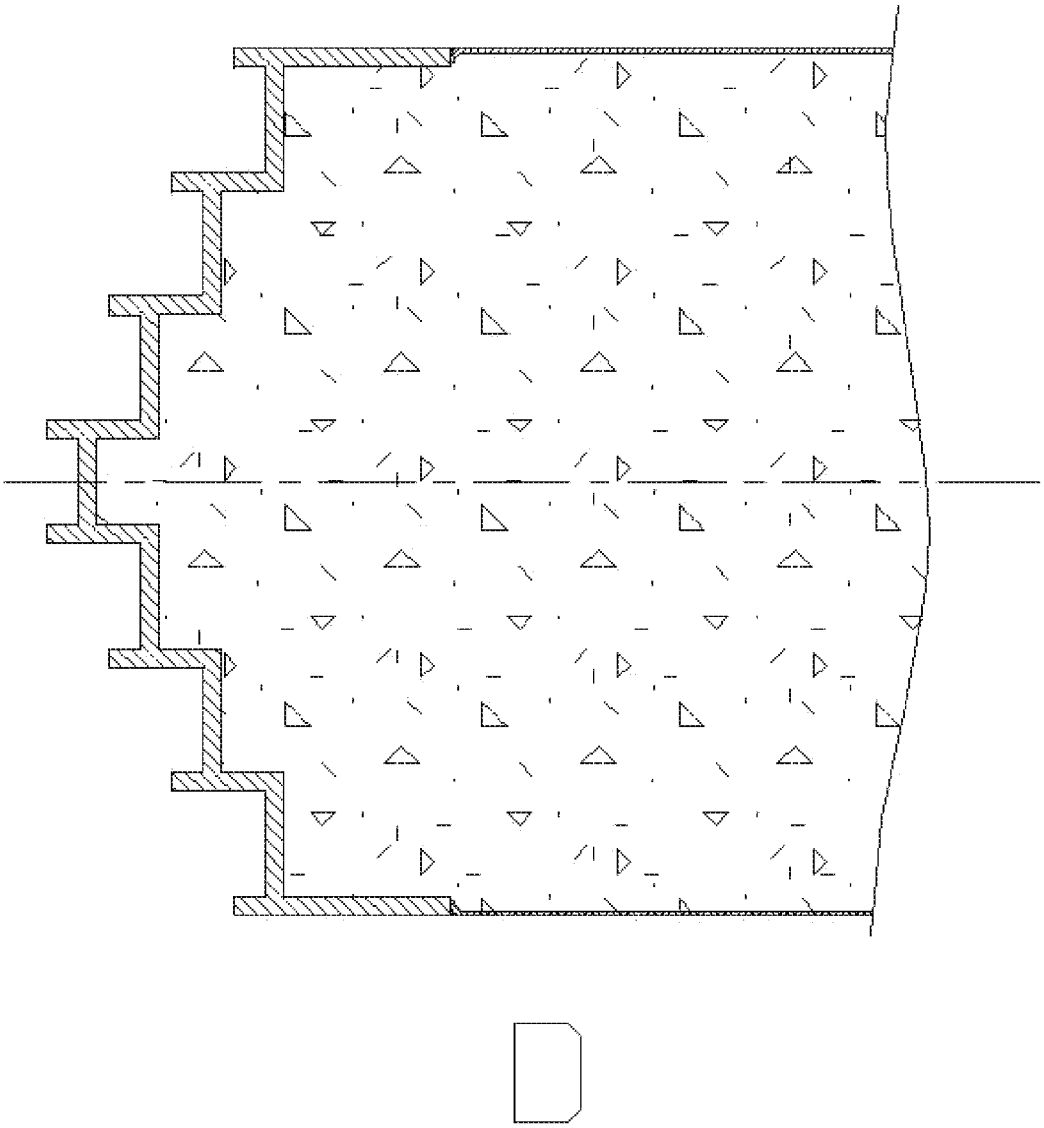

FIG. 25 is the structural schematic diagram of D on cone-shaped multi-row tracks arranged staggered along the longitudinal direction.

Figure 26:
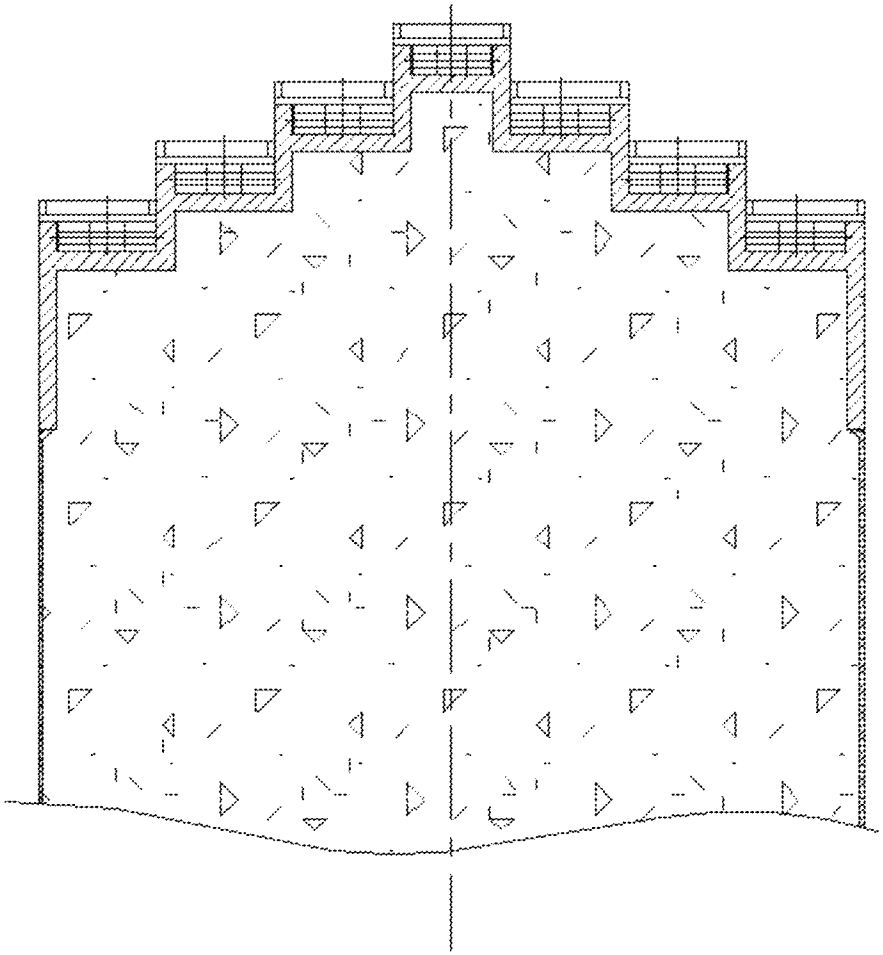

FIG. 26 is a structural schematic diagram of the D-type track and multi-row chain blade of tunneling device 1.

In the figure '1' is the tunneling device of the pipe jacking method, which consists of drive device 1-1 and chain blade 5; 1-1 is the transmission device of excavating device 1, which consists of drive device 1-1-1, tensioning device 1-1-2 and chain wheel 1-1-3; 1-1-1 is the driving device of transmission device 1-1; 1-1-2 is the tensioning device of transmission device 1-1; 1-1-3 is the chain wheel of transmission device 1-1; 2 is the head front-end track of tunneling device; 2-1 is the slurry pipeline on track 2; 3 is the middle-section track of tunneling device; 3-1 is the slurry pipeline on middle-section track 3; 4 is the rear device of tunneling device; 4-1 is the jacking device of rear device 4; 5 is the chain blade of excavating device 1; 5-1 is the chain consisted of chain blade 5, including caterpillar, rope and flexible belt; 5-1-1 is the cross of cross A consisted of chain 5-1; 5-1-2 is the cross B of the cross consisted of chain 5-1; 5-1B is the flexible belt consisted of chain blade 5; 5-2 is the blade for rock and soil excavation fixed on chain 5-1; 5-2B is the blade for rock and soil excavation fixed on flexible belt 5-1B; 6 is the pipe joint of tunneling device; 7 is the working shaft; 8 is a tunnel perpendicular to the longitudinal direction of subway station; 9 is the tunnel parallel to subway station, which is also the main structure of subway station; 9-1 is the square-shaped pipe joint on both sides of subway station 9; 9-2 is the slotted pipe joint at the upper middle of subway station 9; 9-3 is the slotted pipe joint at the lower middle of subway station 9; 10 is the tunnel; 10-1 is the slotted pipe joint in the middle of the tunnel; 10-2 is the U-shaped pipe joint on both sides of the tunnel.

DETAILED DESCRIPTION OF IMPLEMENTATION

A tunneling device for the pipe jacking method consists of an excavating device, head front-end track, middle-section track and rear device; the excavating device consists of a transmission device and chain blade, transmission device consists of a driving device and chain wheel; chain blade consists of chain and blades fixed on the chain; chain blade operates on the head front-end track and the middle-section track during construction to excavate rock and soil. The tail of the head front-end track is connected to the front end of the first pipe joint; the shape of the head excavating face is the same as the that of the cross section of the pipe joint; the rear device includes a jacking device installed in the construction well; the front end of middle-section track is connected to the head front-end track; the tail end of the middle-section track is connected to the rear device, which is located on the external side of or within the pipe joint. During construction, the driving device drives the chain blade to operate along the track. The blade on the head front-end track excavates the annular rock and soil on the projected cross-section of the pipe joint. The chain blade brings the excavated rock and soil back by running backward on the middle-section track. The slurry pipeline is arranged in the excavating device, and nozzles on the end of the pipeline.

The described middle-section track is one component of the pipe joint.

The described chain blade is to replace the blade on the chain in working shafts to adapt to different geological conditions.

The described chain blade is a multi-row chain blade along the transversal direction, which excavates instantaneously or separately as necessary.

The described jacking construction method includes the steps below:

1) Excavate working shafts and build working platforms; Excavate working shafts and build working platforms
2) Install the rear device in working shaft;
3) Connect and fix the first pipe joint and the head front-end track, and install the chain blade on the track;
4) Install the middle-section track;
5) Install the transmission device consisting of the driving device and the chain wheels, to form an excavating device;
6) Install the jacking device;
7) Drive the chain. The chain blade on the front track excavates rock and soil on front and brings it to the rear. The jacking device pushes the tail end of the pipe joint or the jacking driving device. And, the driving device pushes the end of the pipe joint to move the pipe joint forwards;
8) After jacking the first pipe joint through the specified distance, the jacking device retracts. Lower the second pipe joint, and connect the head of the second pipe joint to the end of the first pipe joint;
9) Install the chain blade on the track of the second pipe joint to form the excavating device. The chain blade excavates the rock and soil in front of the first pipe joint. The jacking device pushes the end of the pipe joint or the driving device, and the pipe joint moves forward;
10) Repeat the above actions, complete the construction of the entire pipe joint, and excavate rock and soil in the pipe joint after partial or total completion of pipe joint jacking construction;

2), 3), 4), 5) and 6) actions are listed in no particular order.

The construction method described is the construction method of the subway station, including the steps below:

I. Build working shafts outside the subway station;

II. Build a tunnel perpendicular to the longitudinal direction of the station in the working shafts 1) Install the rear device in working shaft;
2) Connect and fix the first pipe joint and the head front-end track, and install the chain blade on the track;
3) Install the middle-section track;
4) Install the transmission device consisting of the driving device and the tensioning device, etc., to form an excavating device;
5) Install the jacking device;
6) Drive the chain. The chain blade excavates the annular rock and soil on the projected part in front of the head and brings it to the rear. The jacking device pushes the pipe joint, to move the pipe joint forwards;
7) After jacking the first pipe joint through the specified distance, the jacking device retracts. Lower the second pipe joint, and connect the front end of the second pipe joint to the end of the first pipe joint;

8) The jacking device pushes the pipe joint, and the chain blade excavates the rock and soil in front of the head. The jacking device pushes the pipe joint to move the pipe joint forwards;

9) Repeat the above actions, complete the construction of the entire pipe joint, and excavate rock and soil in the pipe joint after partial or total completion of pipe joint jacking construction;

1), 2), 3), 4) and 5) actions are listed in no particular order.

III. Build subway stations in a built tunnel

1) Install the rear device in built tunnels;

2) Connect and fix the first pipe joint and the head front-end track, and install the chain blade on the track;

3) Install the middle-section track;

4) Install the transmission device consisting of the driving device and the tensioning device, etc., to form an excavating device;

5) Install the jacking device;

6) Drive the chain. The chain blade excavates the annular rock and soil on the projected part in front of the head and brings it to the rear. The jacking device pushes the pipe joint, to move the pipe joint forwards;

7) After jacking the first pipe joint through the specified distance, the jacking device retracts. Lower the second pipe joint, and connect the front end of the second pipe joint to the end of the first pipe joint;

8) The jacking device pushes the pipe joint, and the chain blade excavates the rock and soil in front of the head, the jacking device/the jacking pipe joint and the pipe joint moves forwards;

9) Repeat the above actions, complete the construction of the entire pipe joint, and excavate rock and soil in the pipe joint after partial or total completion of pipe joint jacking construction;

1), 2), 3), 4) and 5) actions are listed in no particular order.

The described pipe joint for subway station construction method consists of multiple rows along the transversal direction.

The described multi-row pipe joint along the transversal direction in the subway station construction method is to be jacked in batches during construction.

There are multiple said working shafts along a longitudinal direction or on both sides.

The described jacking pipe joint in the built tunnel is jacked along with two opposite directions.

For a further description of this invention, refer to the followings and figures attached:

As shown in FIGS. 1-5, a tunneling device consists of excavating device 1, head front-end track 2, middle-section track 3 and rear device 4. Excavating device 1 consists of transmission device 1-1 and chain blade 5. Transmission device 1-1 consists of driving device 1-1-1, tensioning device 1-1-2 and chain wheel 1-1-3. Chain blade 5 consists of chain 5-1 and blades 5-2 fixed on the chain 5-1. Track 2-1 is arranged on the front end and both sides of the head front-end track 2 for chain blade 5 to operate. The tail of the head front-end track 2 is connected to the front end of the first pipe joint 6. The shape of the head excavating face is the same as the that of the cross-section of the pipe joint. The rear device 4 includes a jacking device 4-1 installed in the construction well. The front end of middle-section track 2 is connected to the head front-end track 3. The tail end of the middle-section track 3 is connected to the rear device 4, which is located closely adjacent to lateral sides of the tunnel pipe joint 6. The slurry pipeline 3-1 is arranged in the middle-section track 3. During construction, the driving device 1-1-1 drives the chain 5-1, to drive the blade 5-2 to operate along the track. The blade 5-2 on the head front-end track 2 excavates the annular rock and soil on the projected cross-section of the pipe joint. The head front-end track 2 brings the rock and soil excavated by the head back through the chain blade 5 moving backward on the middle-section track 3. The slurry pipeline 2-1 is arranged in the head front-end track 2, and nozzles are provided on the end of the pipeline.

As shown in FIGS. 6-8, the tunnel construction method adopts the jacking pipe method, including the steps below:

1) Excavate working shafts and build working platforms;

2) Install the rear device in working shaft 4;

3) Connect and fix the first pipe joint 6 and the head front-end track, and install the chain blade 3 on the track;

4) Install middle-section track 3;

5) Install the transmission device 1-1 consisted of the driving device 1-1-1 and tensioning device 1-1-2, etc., to form an excavating device 1;

6) Install the jacking device 4-1;

7) Drive the chain 5-1. The blade 5-2 excavates the annular rock and soil on the projected part on the front and brings it to the rear. The jacking device 4-1 pushes the pipe joint 6, to move the pipe joint 6 forwards;

8) After jacking the first pipe joint through the specified distance, the jacking device 4-1 retracts. Disconnect the chain 5-1 of chain blade 5, and the transmission device 1-1 of excavating device 1 also retracts. Lower head of the second pipe joint 6 and the middle-section track 3, and connect the head of the second pipe joint to the end of the first pipe joint, and the tail and end of the front and rear middle-section track 3;

9) After extending the chain blade 5, connect the disconnected chain 5-1. Drive chain 5-1. The chain blade 5 excavates the rock and soil in front. The jacking device 4-1 pushes the pipe joint 6, and the pipe joint 6 moves forward;

10) Repeat the above actions, complete the construction of the entire pipe joint 6, and excavate rock and soil in the pipe joint after partial or total completion of pipe joint jacking construction;

2), 3), 4), 5) and 6) actions are listed in no particular order.

As shown in FIGS. 9 and 10, the tunneling device construction steps for subway station building:

I. Excavate working shaft 7 outside the subway station;

II. Build the tunnel 8 along the longitudinal direction of the station in working shaft 7

As shown in FIGS. 11-14, the specific steps for tunnel 9 construction in working shaft 7:

1) Install rear device 4 in working shaft 7;

2) Connect and fix the first pipe joint 6 and the head front-end track 2, and install the chain blade on the track;

3) Install middle-section track 3 on pipe joint 6;

4) Install the transmission device 1-1 consisting of the driving device 1-1-1 and tensioning device 1-1-2, etc., to form an excavating device 1;

5) Install the jacking device 4-1;

6) Drive the chain 5-1. The blade 5-2 excavates the annular rock and soil on the projected part on the front and brings it to the rear. The jacking device 4-1 pushes the pipe joint 6, to move the pipe joint 6 forwards;

7) After jacking the first pipe joint through the specified distance, the jacking device 4-1 retracts. Disconnect the chain 5-1 of chain blade 5, and the transmission device 1-1 of excavating device 1 also retracts. Lower head of the second pipe joint 6 and the middle-section track 3, and connect the head of the second pipe joint to the end of the first pipe joint, and the tail and end of the front and rear middle-section track 3;

8) After extending the chain blade 5, connect the disconnected chain 5-1. Drive chain 5-1. The chain blade 5 excavates the rock and soil in front. The jacking device 4-1 pushes the pipe joint 6, and the pipe joint 6 moves forward;

9) Repeat the above actions, complete the construction of the entire pipe joint 6, and excavate rock and soil in the pipe joint after partial or total completion of pipe joint jacking construction;

1), 2), 3), 4) and 5) actions are listed in no particular order.

As shown in FIGS. 15-20, build subway station 9 in the built tunnel 8. The subway station 9 consists of square-shaped pipe joint 9-1 on both sides, slotted pipe joint 9-2 in the upper middle and the slotted pipe joint 9-3 in the lower middle. During construction, jacking is carried out in batches. First comes the square-shaped pipe joint 9-1 on both sides, then the slotted pipe joint 9-2 in the upper middle, and finally the slotted pipe joint 9-3 in the lower middle. Excavate the rock and soil in the pipe joint at the partial or complete construction of pipe joint jacking.

As shown in FIGS. 21-23, build tunnel 10 in working shaft 7. Tunnel 10 consists of square-shaped pipe joint 10-1 in the middle and U-shaped pipe joint 10-2 on both sides. During construction, jacking is carried out in batches. First comes the square-shaped pipe joint 10-1 in the middle, then the U-shaped pipe joint 10-2 on both sides separately. Excavate the rock and soil in the pipe joint at the partial or complete construction of pipe joint jacking.

The invention claimed is:

1. A tunneling device for pipe jacking, the tunneling device comprising:

an excavating device comprising a transmission device and a chain blade, the transmission device comprising a driving device and a chain wheel, the chain blade comprising a chain and blades fixed on the chain;

a head front-end track comprising a tail;

a middle-section track comprising a front end and a tail end, the front end of the middle-section track being connected to the head front-end track; and a rear device comprising a jacking device, the tail end of the middle-section track being connected to the rear device, whereby, during construction, the driving device drives the chain blade to operate on the head front-end track and the middle-section track to excavate rock and soil, the blade on the head front-end track excavates the annular rock and soil on a projected cross-section of a pipe joint, and the chain blade brings the excavated rock and soil back by running backward on the middle-section track.

2. The tunneling device of claim 1, wherein the described middle-section track is one component of the pipe joint.

3. The tunneling device of claim 1, wherein the chain blade is adapted to replace the blade on the chain in working shafts to adapt to different geological conditions.

4. The tunneling device of claim 1, wherein the chain blade is a multi-row chain blade along the transversal direction that is adapted to excavate instantaneously or separately.

5. The tunneling device of claim 1, wherein a slurry pipeline is arranged in the excavating device, and nozzles are provided on the end of the pipeline.

6. A method of pipe jacking using a tunneling device, the method comprising:

excavating working shafts and building working platforms;

installing a rear device of a tunneling device in one of the working shafts;

connecting and fixing a first pipe joint and a head front-end track of the tunneling device, and installing a chain blade of the tunneling device on a track of the tunneling device;

installing a middle-section track of the tunneling device;

installing a transmission device of the tunneling device, the transmission device comprising a driving device and a chain wheel, to form an excavating device;

installing a jacking device;

driving a chain of the chain blade, whereby the chain blade on the front track excavates rock and soil on front and brings it to the rear, and the jacking device pushes the tail end of the pipe joint to move the pipe joint forward;

after jacking the first pipe joint through the specified distance, retracting the jacking device, lowering the second pipe joint, and connecting the head of the second pipe joint to the end of the first pipe joint;

installing the chain blade on the track of the second pipe joint to form the excavating device, whereby the chain blade excavates the rock and soil in front of the first pipe joint, the jacking device pushes the end of the pipe joint or the driving device, and the pipe joint moves forward;

repeating the above actions, completing the construction of the entire pipe joint, and excavating rock and soil in the pipe joint after partial or total completion of the pipe joint jacking construction.

7. A method of pipe jacking using a tunneling device, the method comprising:

building working shafts outside a subway station;

building a tunnel perpendicular to the longitudinal direction of the station in the working shafts;

installing a rear device of a tunneling device in one of the working shafts;

connecting and fixing a first pipe joint and a head front-end track of the tunneling device, and installing a chain blade of the tunneling device on a track of the tunneling device;

installing a middle-section track of the tunneling device;

installing a transmission device of the tunneling device, the transmission device comprising a driving device and a tensioning device, to form an excavating device;

installing a jacking device;

driving a chain of the chain blade, whereby the chain blade excavates the annular rock and soil on the projected part in front of the head and brings it to the rear, and jacking device pushes the pipe joint to move the pipe joint forward;

after jacking the first pipe joint through the specified distance, retracting the jacking device, lowering the second pipe joint, and connecting the front end of the second pipe joint to the end of the first pipe joint;

repeating the above actions, completing the construction of the entire pipe joint, and excavating rock and soil in the pipe joint after partial or total completion of the pipe joint jacking construction, building subway stations in a built tunnel;

installing the rear device in a built tunnel;

connecting and fixing the first pipe joint and the head front-end track, and install the chain blade on the track;

installing the middle-section track;

installing the transmission device;

the jacking device;

driving the chain of the chain blade, whereby the chain blade excavates the annular rock and soil on the projected part in front of the head and brings it to the rear, and jacking device pushes the pipe joint to move the pipe joint forward;

after jacking the first pipe joint through the specified distance, retracting the jacking device, lowering the second pipe joint, and connecting the front end of the second pipe joint to the end of the first pipe joint;

repeating the above actions, completing the construction of the entire pipe joint, and excavating rock and soil in the pipe joint after partial or total completion of the pipe joint jacking construction.

8. The method of claim 7, wherein the entire pipe joint comprises multiple rows along the transversal direction.

9. The method of claim 8, comprising jacking the multi-row pipe joint along the transversal direction in batches during construction.

10. The method of claim 7, comprising building multiple of the working shafts along a longitudinal direction or on both sides.

11. The method of claim 7, comprising jacking the jacking pipe joint along two opposite directions.

* * * * *